US011071426B2

(12) United States Patent
Hyun et al.

(10) Patent No.: US 11,071,426 B2
(45) Date of Patent: Jul. 27, 2021

(54) VACUUM CLEANER

(71) Applicant: LG ELECTRONICS INC., Seoul (KR)

(72) Inventors: Kietak Hyun, Seoul (KR); Youngjoo Lee, Seoul (KR); Soohan Eo, Seoul (KR); Jungmin Ko, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 311 days.

(21) Appl. No.: 16/279,546

(22) Filed: Feb. 19, 2019

(65) Prior Publication Data

US 2019/0254494 A1 Aug. 22, 2019

(30) Foreign Application Priority Data

Feb. 20, 2018 (KR) ..... 10-2018-0019883

(51) Int. Cl.

| | |
|---|---|
| ***A47L 9/10*** | (2006.01) |
| ***A47L 5/24*** | (2006.01) |
| ***A47L 9/16*** | (2006.01) |

(52) U.S. Cl.

CPC ..... *A47L 9/108* (2013.01); *A47L 5/24* (2013.01); *A47L 9/1608* (2013.01); *A47L 9/1616* (2013.01); *A47L 9/1658* (2013.01); *A47L 9/1683* (2013.01); *A47L 9/1691* (2013.01)

(58) Field of Classification Search

CPC ..... A47L 9/108; A47L 5/24; A47L 9/1608; A47L 9/1616; A47L 9/1658; A47L 9/1683; A47L 9/1691

See application file for complete search history.

(56) References Cited

U.S. PATENT DOCUMENTS

| | | | |
|---|---|---|---|
| 7,407,524 | B2 | 8/2008 | Han et al. |
| 7,547,340 | B2 | 6/2009 | Park |
| 7,854,782 | B2 | 12/2010 | Oh et al. |
| 2006/0053757 | A1 | 3/2006 | Han et al. |
| 2010/0206173 | A1 | 8/2010 | Oh |
| 2012/0255140 | A1 | 10/2012 | Tomita et al. |
| 2017/0319030 | A1 | 11/2017 | Hyun et al. |

FOREIGN PATENT DOCUMENTS

| | | | |
|---|---|---|---|
| EP | 1 671 569 | A1 | 6/2006 |
| EP | 1 987 754 | A2 | 11/2008 |
| EP | 2 255 709 | A1 | 12/2010 |
| JP | 2006-075584 | | 3/2006 |
| JP | 2010-246722 | | 11/2010 |
| JP | 5237770 | | 7/2013 |
| KR | 10-0880492 | | 1/2009 |
| KR | 10-2010-0108839 | | 10/2010 |
| KR | 10-1127088 | | 3/2012 |

(Continued)

OTHER PUBLICATIONS

Korean Office Action dated Feb. 26, 2019 issued in KR Application No. 10-2018-0019883.

(Continued)

*Primary Examiner* — Andrew A Horton
(74) *Attorney, Agent, or Firm* — KED & Associates LLP

(57) ABSTRACT

A cleaner includes: at least one cyclone configured to separate dust from suctioned air; a dust container configured to store the dust separated by the at least one cyclone; a dust compressor provided inside the dust container; and a lifter configured to move the dust compressor upward and downward.

20 Claims, 30 Drawing Sheets

(56) References Cited

FOREIGN PATENT DOCUMENTS

| | | |
|---|---|---|
| TW | I409046 | 9/2013 |
| TW | I501747 | 10/2015 |
| TW | I576082 | 4/2017 |

OTHER PUBLICATIONS

Korean Notice of Allowance dated Jun. 19, 2019 issued in KR Application No. 10-2018-0019883.
International Search Report dated Jun. 20, 2019 issued in PCT/KR2019/002063.
Australian Examination Report dated May 28, 2021 issued in Application 2019224777.

VACUUM CLEANER

CROSS-REFERENCE TO RELATED APPLICATION

This application claims priority under 35 U.S.C. § 119 to Korean Application No. 10-2018-0019883 filed on Feb. 20, 2018, whose entire disclosure is hereby incorporated by reference.

BACKGROUND

1. Field

The present disclosure relates to a cleaner.

2. Background

A cleaner may be a device that performs cleaning by suctioning or cleaning dust or foreign substances in an area. Such a cleaner may be classified into a manual cleaner which performs cleaning as a user moves the cleaner, and an automatic cleaner which performs cleaning by traveling on its own. In addition, the manual cleaner may be classified into a canister type cleaner, an upright type cleaner, a handy type cleaner, a stick type cleaner, etc.

A related art Korean Patent No. 10-1127088 (Registered on Mar. 8, 2012) discloses a hand-held vacuum cleaner. The hand-held vacuum cleaner may include a suction conduit, an airflow generator, a cyclonic separating apparatus, a dust container, a power source, and a handle.

The cyclonic separating apparatus may be provided between the handle and the suction conduit, the airflow generator may be provided right over the handle, and the power source may be provided right below the handle. Accordingly, the airflow generator and the power source may be provided behind the airflow generator.

The dust container that stores dust collected in the cyclonic separating apparatus may be provided below the cyclonic separating apparatus. When the dust container is opened by a user to remove the collected dust, the dust may be released from the dust container and may harm a user's health and cause the surroundings of the dust container to be contaminated again. In addition, the dust container of the related art may include a cyclonic separating apparatus, and dust collected in the dust container may be stuck to the outer surface of the cyclonic separating apparatus and may be hard to remove.

Patent Document

Korean Patent No. 10-1127088 (Registered on Mar. 8, 2012)

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
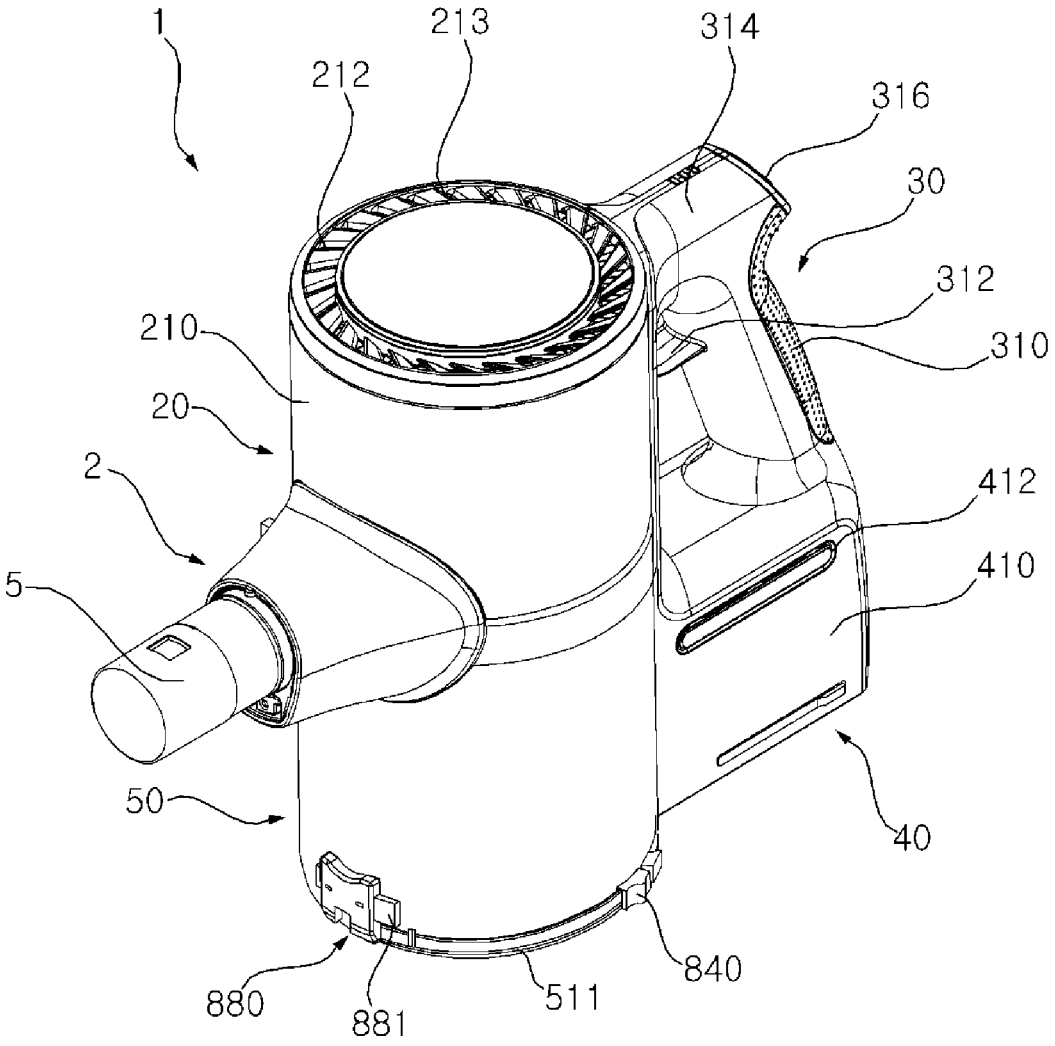
FIG. 1 is a perspective view of a cleaner according to an embodiment of the present disclosure.
Figure 2:
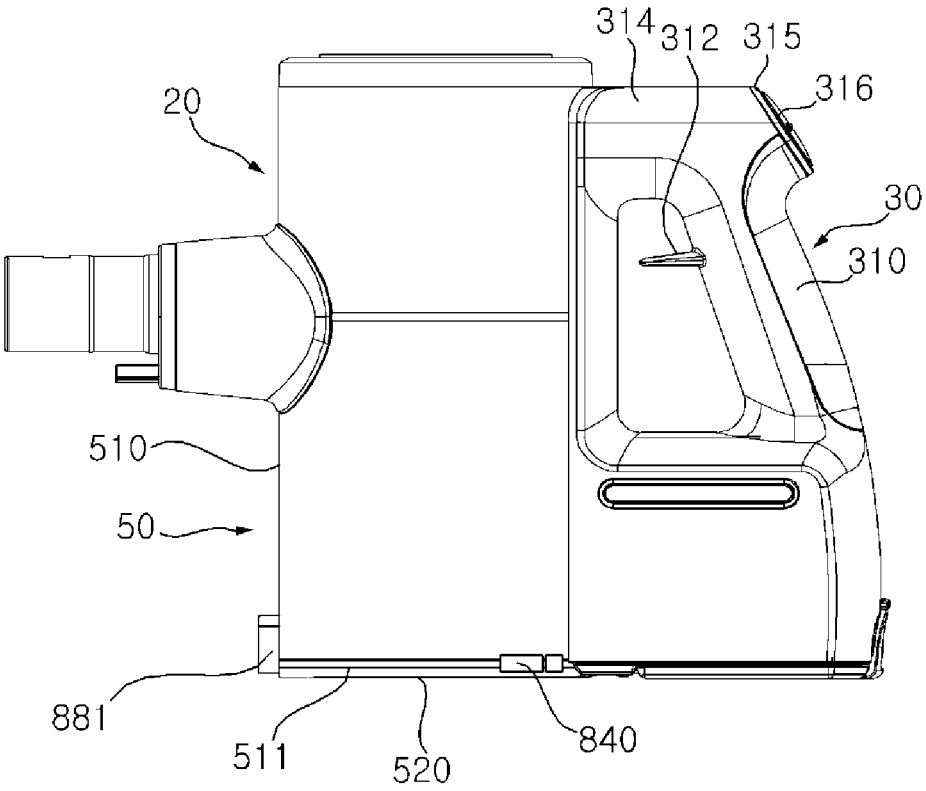
FIG. 2 is a side view of the cleaner according to an embodiment of the present disclosure.

Referring to FIGS. 1 to 5, a cleaner 1 according to an embodiment of the present disclosure may include a main body 2. The main body 2 may include a suction unit (or suction pipe) 5 through which air including dust is suctioned. In addition, the main body 2 may further include a dust separation unit (or cyclone) 10 which may separate dust from the air suctioned inside through the suction pipe 5, and a dust container 50 to store the dust separated by the cyclone 10.

In one example, the cyclone 10 may include a first cyclone 110 capable of separating dust using cyclonic airflow. The first cyclone 110 may communicate with the suction pipe 5. The first cyclone 110 may linearly circulate air and dust, which are suctioned through the suction pipe 5, along an inner circumferential surface of the first cyclone 110. An axis A2 of a cyclonic airflow of the first cyclone 110 may extend in an upward-downward or vertical direction.

The cyclone 10 may further include a second cyclone 130 which separates dust again from air discharged from the first cyclone 110. In this case, the second cyclone 130 may be provided inside the first cyclone 110 so that the cyclone 10 has a minimum size. An axis of a cyclonic airflow of the second cyclone 130 may extend in the vertical direction. In another example, the cyclone 10 may have a single cyclone, and, even in this case, the axis A2 of the cyclonic airflow may extend in the vertical direction.

The dust container 50 may include a cylindrical dust collecting body 510, and a body cover 520 rotatably coupled to the bottom of the dust collecting body 510. In this embodiment, the first cyclone 110 may not be provided, and instead an upper part of the dust collecting body 510 may act as the first cyclone 110. At least a part of the second cyclone 130 may be provided inside the dust container 50.

The dust collecting body 510 may include a dust storage guide 504 which guides a storage of the dust separated by the second cyclone 130. The dust storage guide 504 may be coupled to the bottom of the second cyclone 130 and may contact an upper surface of the body cover 520.

The dust storage guide 504 may partition an inner space of the dust collecting body 510 into a dust storage (or first dust storage) 502, in which dust separated by the first cyclone 110 is stored, and an inner or second dust storage 506, in which dust separated by the second cyclone 130 is stored. An inner space of the dust storage guide 504 may be the inner dust storage 506, and a space between the dust storage guide 504 and the dust collecting body 510 may be the dust storage 502.

The body cover 520 may open and close the dust storage 502 and the inner dust storage 506 together. The body cover 520 may include a rib 521 to prevent the dust stored in the dust storage 502 from rotating by cyclonic airflow. The rib 521 may extend upward from the body cover 520. While the body cover 520 covers first and second dust storages 502 and 506, the rib 521 may be positioned adjacent to an inner circumferential surface of the dust collecting body 510.

A cyclonic airflow may flow in the first dust storage 502 along the inner circumferential surface of the dust collecting body 510. Accordingly, if the rib 521 is positioned adjacent to the inner circumferential surface of the dust collecting body 510, the cyclonic airflow may be broken by the rib 521 and therefore dust stored in the dust storage 502 may be prevented from rotating.

The main body 2 may further include a suction force generation unit (or suction fan assembly) 20 that generates a suction force. The suction fan assembly 20 may include a motor housing 210, and a suction motor 230 received in the motor housing 210.

At least a part of the suction motor 230 may be provided over the cyclone 10. Accordingly, the suction motor 230 may be provided over the dust container 50. For example, a part of the suction motor 230 may be provided inside the first cyclone 110.

The bottom of the suction motor 230 may be connected to an upper portion of the second cyclone 130. Accordingly, the axis A2 of a cyclonic airflow of the cyclone 10 may pass through the suction motor 230. The suction motor 230 may be positioned higher than a longitudinal axis A3 of the suction pipe 5.

The longitudinal axis A3 of the suction pipe 5 may be an arbitrary line that passes through the center of the suction pipe 5, the axis A2 of the cyclonic airflow of the first cyclone 110, and the center of the handle 30. When the suction motor 230 is arranged over the second cyclone 130, air discharged from the second cyclone 130 may flow directly toward the suction motor 230, and therefore, a passage between the cyclone 10 and the suction motor 230 may be minimized.

The suction motor 230 may include a rotary impeller 232. The impeller 232 may be connected to a shaft 233. The shaft 233 may extend in the vertical direction, and at least a part of the shaft 233 may be provided inside the cyclone 10. In this case, when the dust container 50 and the suction motor 230 are arranged in the vertical direction, the cleaner 1 may have a compact size.

An extension line of a rotational axis A1 (or an axis of the suction motor) of the impeller 232 may pass through the cyclone 10 and the dust container 50. In this case, the rotational axis A1 of the impeller 232 and the axis A2 of a cyclonic airflow generated by the first cyclone 110 of the cyclone 10 may be on the same line.

Air discharged from the cyclone 10, or specifically air discharged upward from the second cyclone 130 may flow to the suction motor 230, and thus a change in direction of air may be minimized even while the air passes through the suction motor 230, and thus, a loss of airflow may be reduced. When the loss of airflow is reduced, a suction force may increase, and the use time of a battery 40 that supplies power to the suction motor 230 may increase. Between the suction motor 230 and the second cyclone 130, there may be a PCB 250 to control the suction motor 230.

The cleaner 1 may further include the handle 30 and the battery 40 that supplies power to the suction motor 230. The handle 30 may be provided behind the suction motor 230. Accordingly, an axis of the suction motor 230 may be positioned between the suction nozzle 5 and the handle 30.

As for directions, with respect to the suction motor 230 in the cleaner 1, a direction in which the suction pipe 5 is positioned may be referred to as the front direction and a direction in which the handle 30 is positioned may be referred to as the rear direction. The battery 40 may be provided under the handle 30. In addition, the battery 40 may be provided behind the dust container 50. The suction motor 230 and the battery 40 may not to overlap each other in the vertical direction, and the suction motor 230 and the battery 40 may be arranged at different heights.

Since the suction motor 230, which may be heavy, may be provided ahead of the handle 30 and the battery 40, which may be heavy, may be provided behind the handle 30, weight may be uniformly distributed throughout the cleaner 1. Thus, injuries to a user's wrist may be prevented when the user holds the handle 30. Since the heavy components are distributed at the front and rear portions and at different heights in the cleaner 1, it may be possible to prevent the center of gravity of the cleaner 1 from concentrating on any one side.

Since the battery 40 may be provided under the handle 30 and the suction motor 230 may be provided ahead of the handle 30, there may be no component over the handle 30. That is, the upper surface of the handle 30 may form a portion of the upper exterior of the cleaner 1. Accordingly, it may be possible to prevent any component of the cleaner 1 from coming in contact with the user's arm while the user holds the handle 30.

The handle 30 may include a first extension 310 that extends in the vertical direction to be held by a user, and a second extension 314 that extends toward the suction motor 230 over the first extension 310. At least a part of the second extension 314 may extend in a horizontal direction.

A stopper 312 that prevents a user's hand from moving in the longitudinal direction (the vertical direction in FIG. 2) while holding the first extension 310 may be formed on the first extension 310. The stopper 312 may extend toward the suction motor 230 from the first extension 310.

The stopper 312 may be spaced apart from the second extension 320. Accordingly, when a user hold the first extension 310, some of the user's fingers may be positioned over the stopper 312 and the other fingers may be positioned under the stopper 312. For example, the stopper 312 may be positioned between the index finger and the middle finger.

The longitudinal axis A3 of the suction pipe 5 may pass through the first extension 310. In this case, the stopper 312 may be positioned higher than the longitudinal axis A3 of the suction pipe 5. According to this arrangement, when a user holds the first extension 310, the longitudinal axis A3 of the suction pipe 5 may pass through the user's wrist.

When the longitudinal axis A3 of the suction pipe 5 passes through the user's wrist and the user's arm is stretched, the longitudinal axis A3 of the suction unit 5 may be substantially aligned with the user's stretched arm. Accordingly, the user may use minimum force when pushing or pulling the cleaner 1 while holding the handle 30.

The handle 30 may include an inclined surface 315 on which an operation unit or button 316 is provided. Using the operation button 316, it may be possible to input an instruction to turn on/off the cleaner (suction motor).

The inclined surface 315 may face a user. For example, the inclined surface 315 may be provided at a rear surface of the second extension 314. The operation button 316 may be provided opposite to the stopper 312 with the handle 30 therebetween.

The operation button 316 provided on the inclined surface 315 may be positioned higher than the stopper 312. Accordingly, a user may be able to operate the operation button 316 with a thumb with holding the first extension 310. In addition, since the operation button 316 may be positioned outside the first extension 310, the operation button 316 may not be unintentionally operated when a user performs cleaning while holding the first extension 310.

A display 318 configured to show operation states may be provided in or at the second extension 314. For example, the display 318 may be positioned on an upper surface of the second extension 314. Accordingly, a user may easily check the display 318 positioned on the upper surface of the second extension 320 while cleaning. The display 318, for example, may show a remaining capacity of the battery 40 and the intensity of the suction motor.

The display 318, although not limited, may include a plurality of light emitting units. The plurality of light emitting units may be spaced apart from each other in the longitudinal direction of the second extension 314.

A battery housing 410 may be provided under the handle 30, and the battery 40 may be received in the battery housing 410. The battery housing 410 may be positioned under the first extension 310. The battery 40 may be detachably coupled to the battery housing 410. For example, the battery 40 may be inserted into the battery housing 410 from under the battery housing 410.

A dissipation hole 412 configured to allow heat generated in the battery 40 to be discharged may be formed in the battery housing 410. As heat is discharged through the dissipation hole 412 to an outside of the battery housing 410, the battery 40 may be cooled smoothly and the lifetime of the battery 40 may increase.

A rear surface of the battery housing 410 and a rear surface of the first extension 310 may form a continuous surface. Accordingly, the housing 410 and the first extension 310 may provide a sense of integrity.

Figure 3:
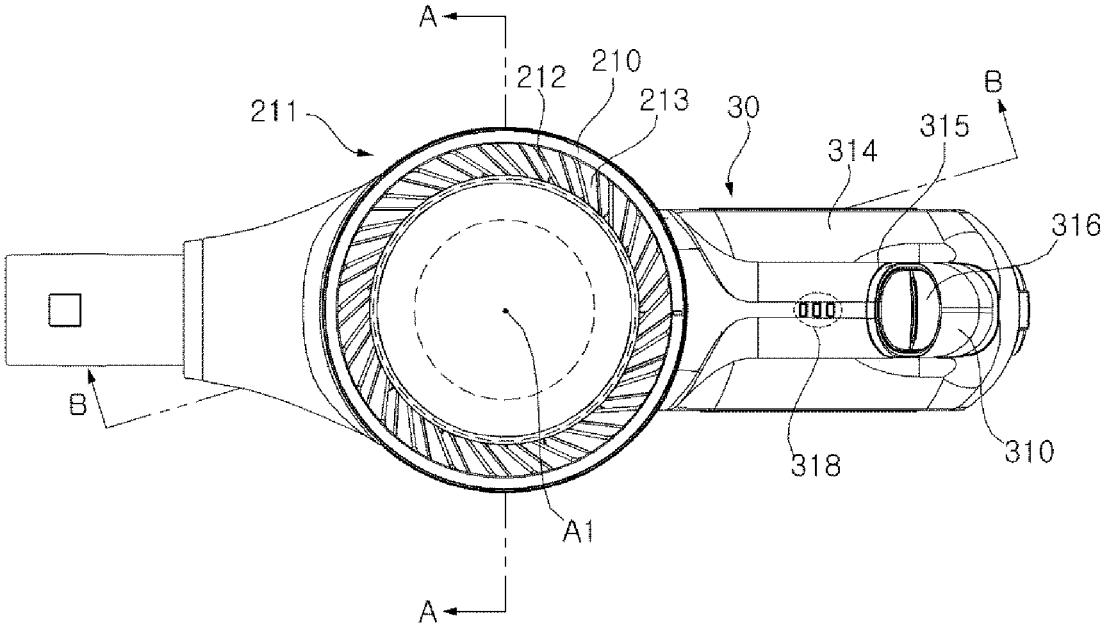
FIG. 3 is a plan view of the cleaner according to an embodiment of the present disclosure.

Referring to FIG. 3, the motor housing 210 may include a discharge cover 211 having an air outlet 212 from which air having passed the suction motor 230 is discharged. A HEPA filter 246 that filters air may be received in the discharge cover 211.

The air outlet 212 may surround the rotational axis A1 of the impeller 232. In this case, an airflow guide 213 may be provided in the discharge cover 210, so that air discharged from the air outlet 212 may be discharged in an inclined direction from the rotational axis A1 of the impeller 232.

An air outlet may not be formed in at least a partial region between the rotational axis A1 and the handle 30 with reference to FIG. 3, so that air discharged from the air outlet 212 is prevented from flowing toward a user. In another example, a barrier configured to block air from being discharged from the air outlet 212 may be provided in at least a partial region between the rotational axis A1 of the impeller 232 and the handle 30 with reference to FIG. 3.

Figure 4:
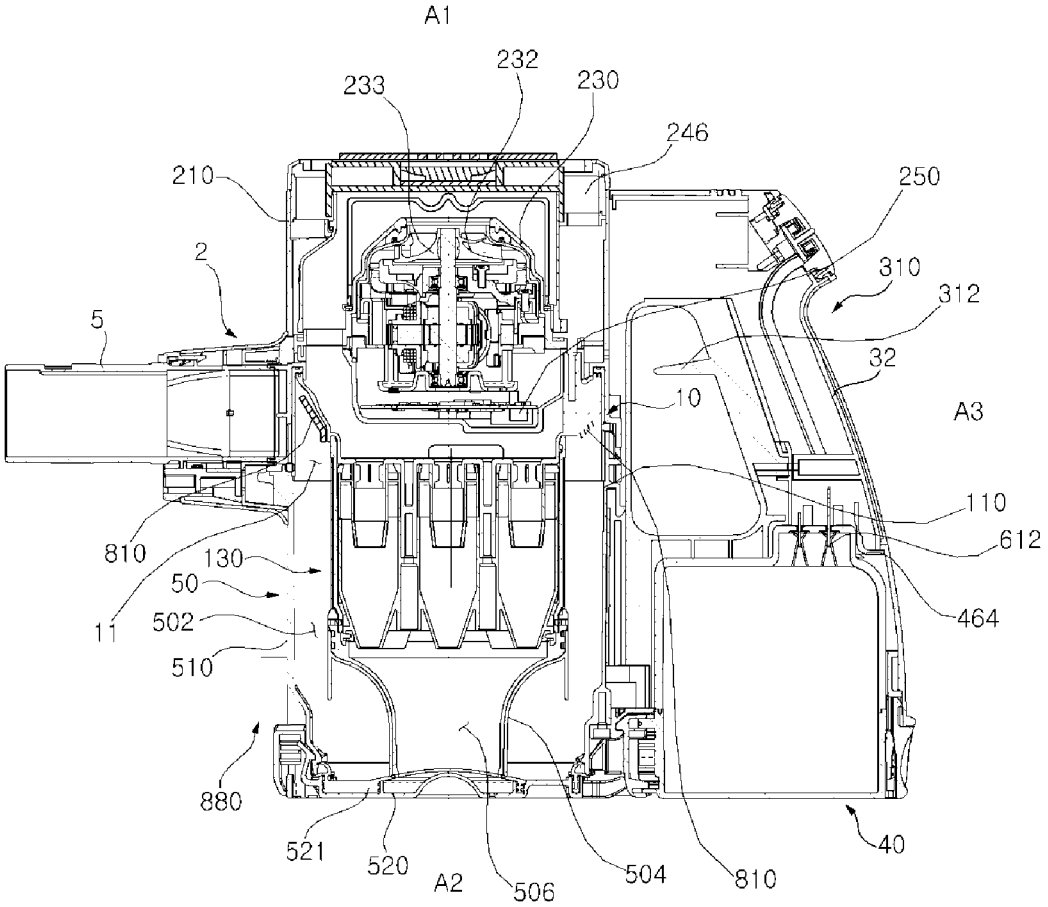
FIG. 4 is a vertical cross-sectional view of the cleaner according to an embodiment of the present disclosure.
Figure 5:
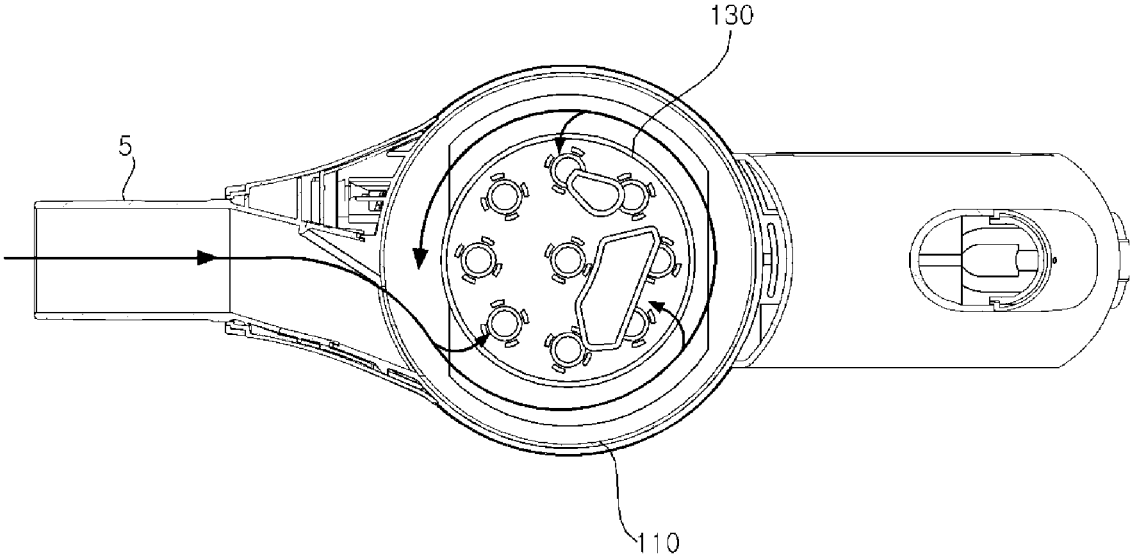
FIG. 5 is a horizontal cross-sectional view of the cleaner according to an embodiment of the present disclosure.
Figure 6:
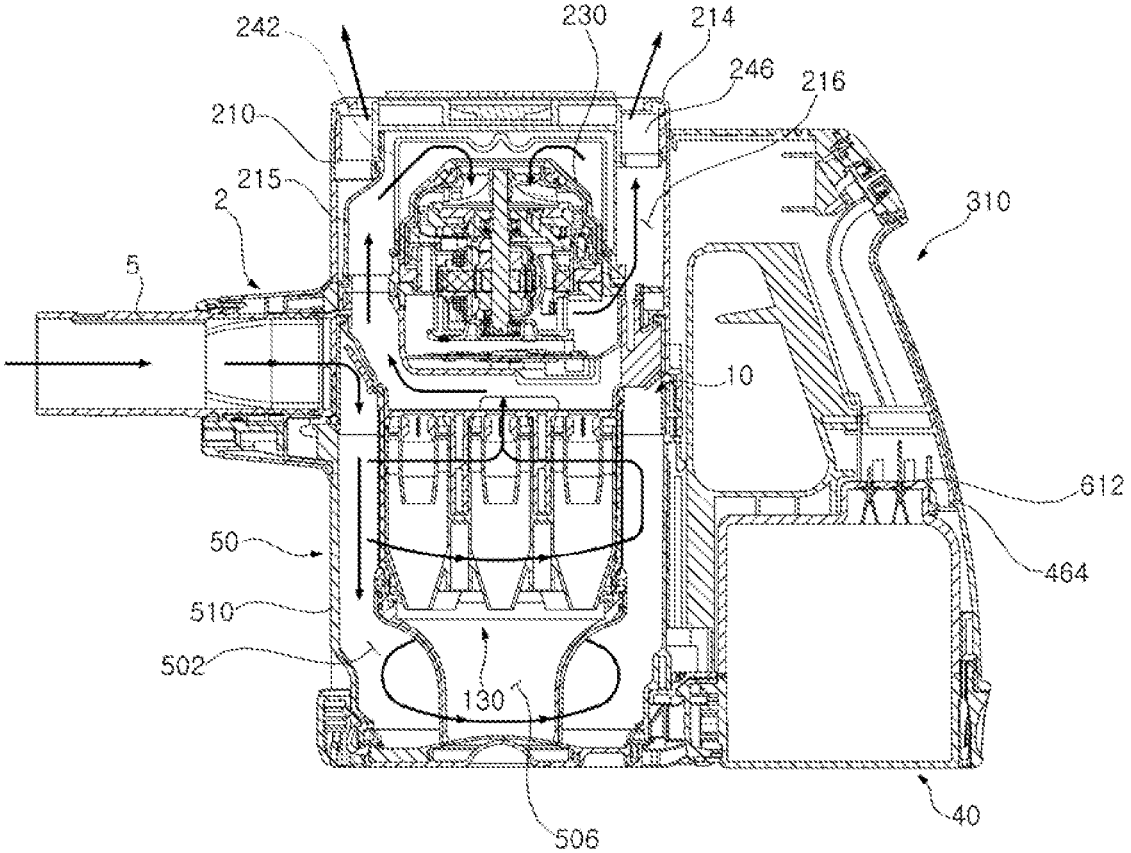
FIG. 6 is a diagram illustrating an airflow in a cleaner according to an embodiment of the present disclosure.
Figure 7:
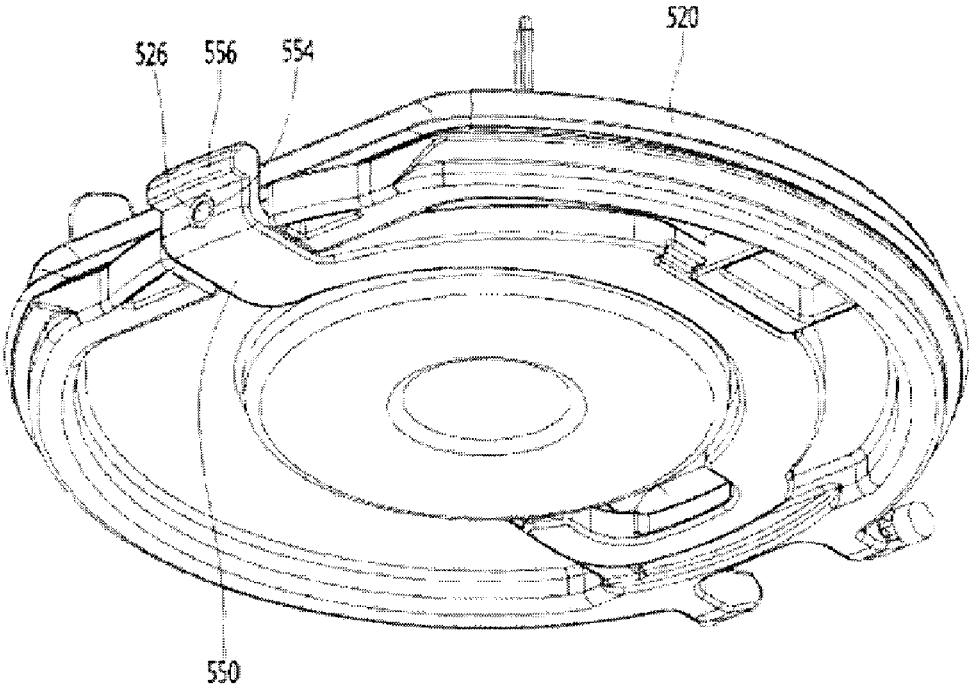
FIG. 7 is a perspective view of a body cover according to an embodiment of the present disclosure.

Referring to FIGS. 4, 6, and 7, the cleaner 1 may further include a pre-filter 242 which filters air before the air is suctioned into the suction motor 230. The pre-filter 242 may surround a part of the suction motor 230. The rotational axis A1 of the impeller 232 may pass through the pre-filter 242.

The air passing through the pre-filter 242 may flow toward the impeller 232 of the suction motor 230, pass through the suction motor 230 and the HEPA filter 246 sequentially, and then may be discharged to an outside through the air outlet 212. The cleaner 1 may include the pre-filter 242 and the HEPA filter 246, but there is no limitation on the types or number of filters. In this specification, the pre-filter 242 may be referred to as a first filter, and the HEPA filter 246 may be referred to as a second filter.

The discharge cover 211 may include a receiving part (or housing) 214 to receive the HEPA filter 246. The housing 214 may have an opened bottom, so the HEPA filter 246 may be received into the housing 214 under the discharge cover 211. In addition, the air outlet 212 may be formed in the discharge cover 211 to face the HEPA filter 246.

While being received in the receiving part 214, the HEPA filter 246 may be covered by a filter cover. One or more openings may be provided in the filter cover to allow air to pass therethrough. The filter cover may be detachably coupled to the discharge cover 211.

The discharge cover 211 may be detachably coupled to the motor housing 210. Accordingly, the discharge cover 211 may be detached from the motor housing 210 to clean the HEPA filter 246. If the filter cover is detached from the discharge cover 211 being detached from the motor housing 210, it may be possible to take the HEPA filter 246 out of the housing 214.

While the discharge cover 211 is detached from the motor housing 210, the pre-filter 242 may be exposed. Accordingly, a user may be able to clean the pre-filter 242 by detaching the exposed pre-filter 242 from the motor housing 210. The discharge cover 211 may be detachable from the motor housing 210 and the user may be able to access the HEPA filter 246 and the pre-filter 242, and therefore, the user may be able to detach and clean the filters 242 and 246.

Referring to FIG. 6, an airflow in the cleaner 1 will be described. Air and dust suctioned through the suction pipe 5 by operation of the suction motor 230 may be separated from each other while flowing along the inner circumferential surface of the first cyclone 110. The dust separated from the air may flow downward to be stored in the dust storage 502. The air separated from the dust may flow into the second cyclone 130. Dust in the second cyclone 130 may be separated from the air again.

The dust separated from the air in the second cyclone 130 may flow downward to be stored in the internal dust storage 506. The air separated from the dust in the second cyclone 130 may be discharged from the second cyclone 130 and may flow upward to the suction motor 230.

An air guide 215 that guides the air discharged from the second cyclone 130 to the pre-filter 242 may be formed outside of the suction motor 230. The air guide 215 may surround the suction motor 230, and at least a part of the air guide 215 may be spaced apart from the suction motor 230.

Accordingly, air may flow upward along the air guide 215 external to the suction motor 230 and the pass through the pre-filter 242. The air passing through the pre-filter 242 may pass through the suction motor 230. The air may flow inside the suction motor 230 by the impeller 232 and then may be discharged to a discharge passage 216 between the air guide 15 and the motor housing 210. In addition, the air discharged to the discharge passage 216 may pass through the HEPA filter 246 and then may be discharged to an outside through the air outlet 212 of the discharge cover 210.

Figure 9A:
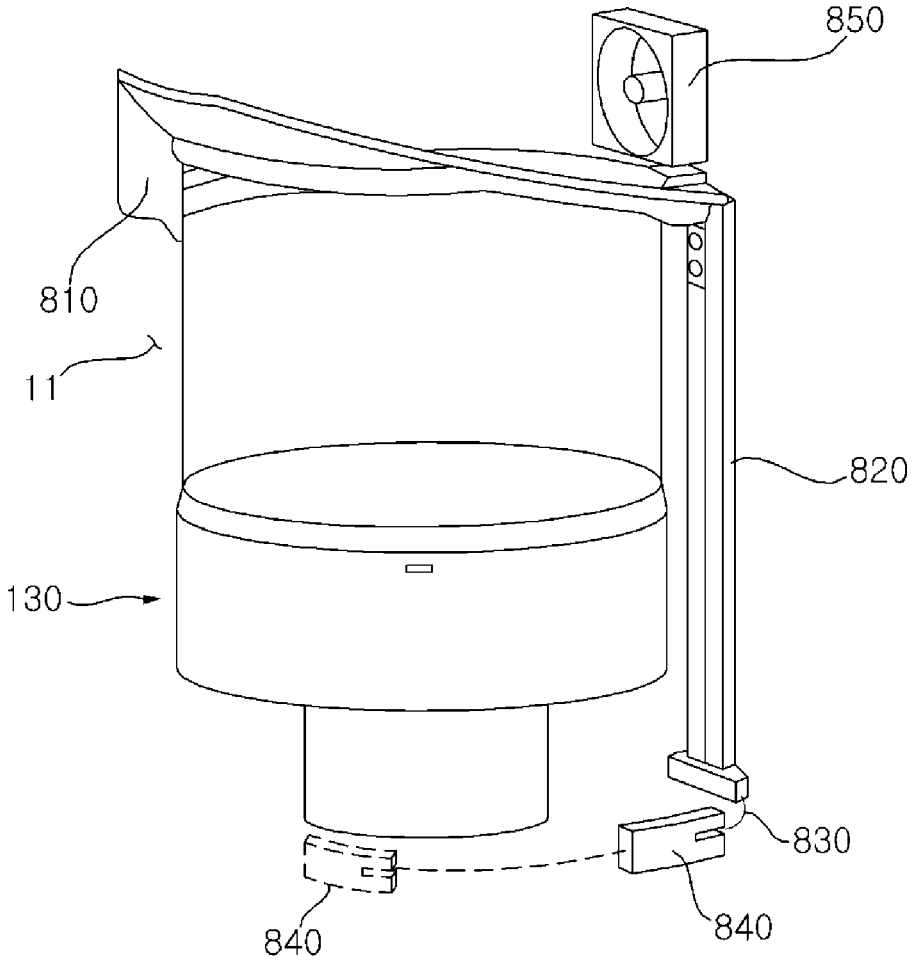
FIG. 9A is a diagram illustrating a cleaning compressor and a movement unit according to an embodiment of the present disclosure.
Figure 9B:
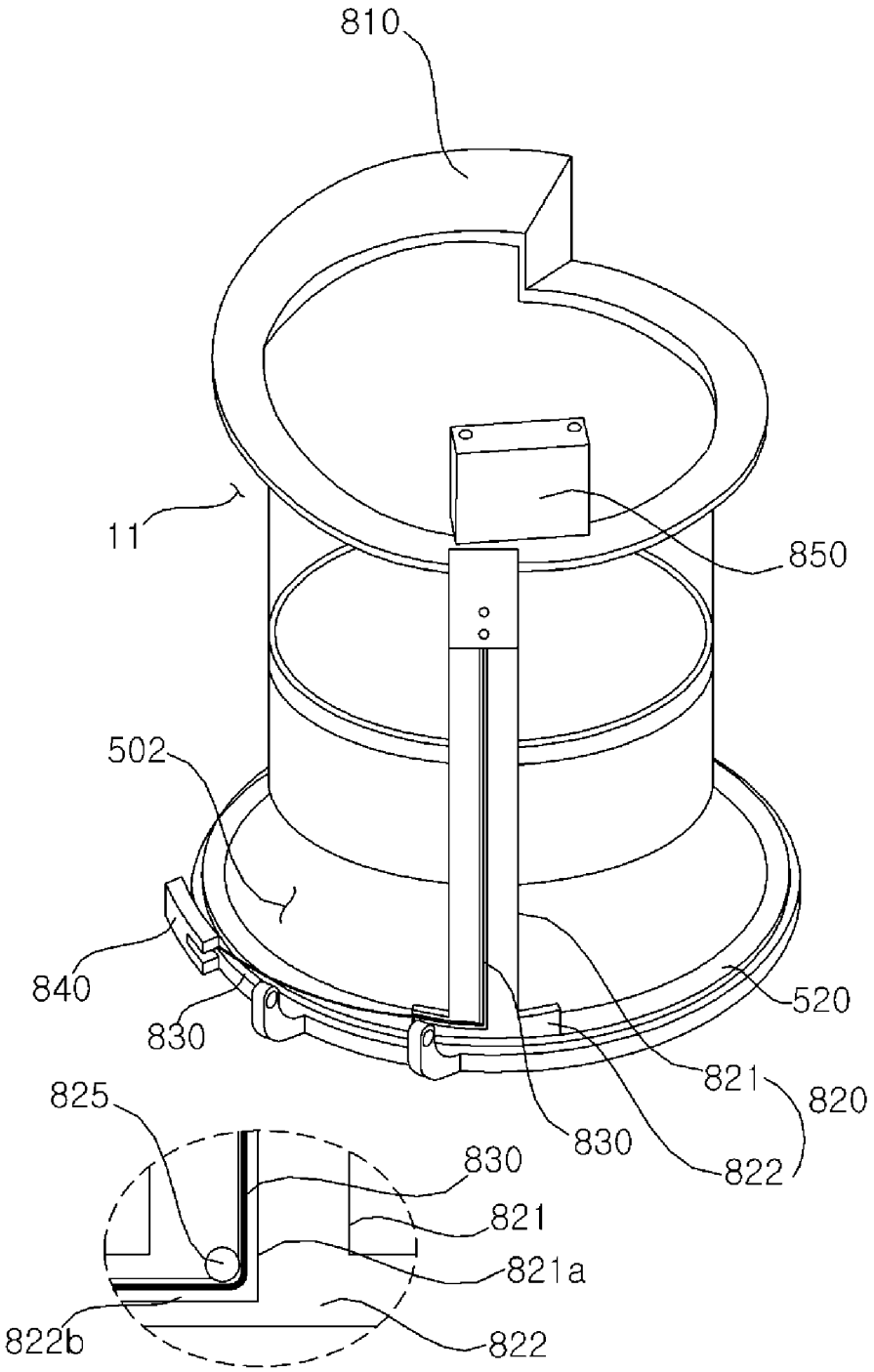
FIG. 9B is a diagram illustrating the cleaning compressor and the movement unit viewed from a direction different from FIG. 9A.

Dust separated in the cyclone may be accumulated in the dust storage 502, and when a user opens the dust container 50, the dust may disperse because the dust is light in weight, and it may be difficult to throw out the dust because the dust may not be formed in a lump. To solve this problem, a cleaning compressor (or dust compressor) 900 configured to compress dust and a movement unit configured to move the cleaning compressor 900 may be provided. The cleaning compressor 900 and the movement unit (or lifter) will be described with reference to FIG. 9.

Figure 8:
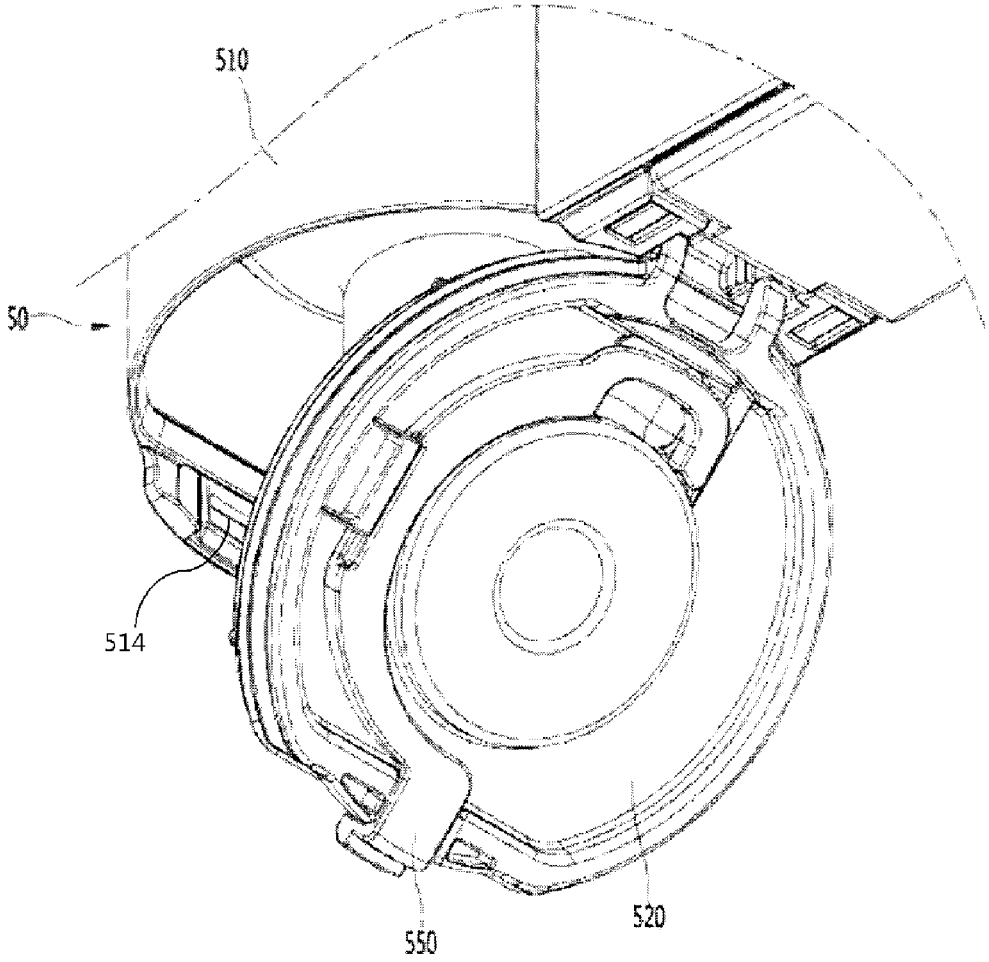
FIG. 8 is a diagram illustrating a bottom structure of a cleaner according to an embodiment of the present disclosure.

Referring to FIGS. 7 and 8, the body cover 520 may open and close the bottom of the dust collecting body 510 by being rotated. The body cover 520 may include a hinge 522 about which the body cover 520 may rotate.

The hinge 522 may be coupled to the dust collecting body 510 or to a hinge coupling portion 420 which is provided separately from the dust collecting body 510. When the hinge coupling portion is a component separate from the dust collecting body 510, the hinge coupling portion may be coupled to the dust colleting body 510. The hinge coupling portion may be positioned inside the battery housing 410.

The hinge 522 of the body cover 520 may be external to the dust collecting body 510 and positioned between the dust collecting body 510 and the battery 40. In addition, the hinge 522 may be positioned between the axis A2 of a cyclonic airflow of the dust collecting body 510 and the battery 40.

The hinge 522 of the body cover 520 may overlap the handle 30 in the vertical direction. Accordingly, when the body cover 520 is rotated by the hinge 522, the body cover 520 may be rotated in a direction proximal to the user. If the body cover 520 is rotated in the direction proximal to the user, the body cover 520 may prevent dust from flowing toward the user when dust stored in the dust collecting body 510 drops upon rotation of the body cover 520.

In another example, the hinge coupling portion may be coupled to the battery housing 410 or formed integrally with the battery housing 410. Even in this case, the hinge coupling portion may be external to the dust collecting body 510 and positioned between the dust collecting body 510 and the battery 40.

A coupling lever 550, which can be moved by a user and coupled to the dust collecting body 510, may be provided in the body cover 520. The coupling lever 550 may be, for example, coupled to the body cover 520 in a direction parallel to the longitudinal axis A3 of the suction unit 5. The body cover 520 may guide movement of the coupling lever 550, and may include a guide which prevents the coupling lever 550 from separating downward.

The coupling lever 550 may include a coupling hook 556, and the dust collecting body 510 may include a hook coupling slot 514 to which the coupling hook 556 is to be coupled. Of course, the hook coupling slot 514 may be formed in a fastening unit (or hinge) 880 which will be described later on.

When positioned inside the dust collecting body 510, the coupling hook 556 may be coupled to the hook coupling slot 514. Although not illustrated, an elastic member that provides an elastic force to the coupling lever 550 to maintain the coupling hook 556 to be fitted into the hook coupling slot 514 may be provided between the body cover 520 and the coupling lever 550.

The fastening member 880 may fasten the body cover 520 and the dust collecting body 510. The fastening member 880 may be configured such that the coupling hook is coupled by an elastic force and decoupled by an external force. In another example, the fastening member 880 may include an opening button 881*a* and 881*b* for releasing the coupling hook coupled to the hook coupling slot of the dust collecting body 510. The opening button 881*a* and 881*b* may be configured to release a coupling between the body cover 520 and the dust collecting body 510. Detailed description thereof will be provided with reference to FIG. 12.

The hinge coupling portion may further include a first body terminal 600 to charge the battery 40 mounted in the housing 410. If the cleaner 1 is seated in a charging station which is not illustrated in the drawings, a terminal of the charging station may be brought into contact with the first body terminal.

The first body terminal may be positioned on a bottom surface of the hinge coupling portion and may be spaced apart from a floor when the cleaner 1 is placed on the floor. That is, a groove 421 recessed upward may be formed in the bottom surface of the hinge coupling portion, and the first body terminal may be provided in the groove 421. In this case, it may be possible to prevent damage to the first body terminal. In addition, since the first body terminal is provided in the groove 421, it may be possible to prevent water from contacting the first body terminal 600 when the cleaner 1 is placed on the floor.

Hereinafter, the cleaning compressor 900 and the movement unit for cleaning and compressing dust in the dust container 50 will be described. Referring to FIGS. 9A to 13, the cleaner of the present disclosure may further include the cleaning compressor 900 configured to move upward and downward in the dust container 50, and the movement unit configured to move the cleaning compressor 900 so as to compress dust exiting between the cleaning compressor 900 and the inner surface of the dust container 50.

A cyclone may include a single cyclone (the second cyclone 130), the dust collecting body 510 of the dust container 50 may surround the second cyclone 130, and the upper part of the dust collecting body 510 may act as a cyclone.

The dust collecting body 510 may surround the cyclone 10 on a surface transverse to the vertical direction, and the body cover 520 may cross the cyclone 10. On a horizontal cross-sectional surface orthogonal to the vertical direction, the dust collecting body 510 may be provided in a circular shape that surrounds the second cyclone 130.

The dust storage 502 may be defined between an outer surface of the cyclone 10 and an inner surface of the dust collecting body 510. In a broad sense, the dust storage 502 may be a space between the outer surface of the second cyclone 130 and the dust collecting body 510/the body cover 520. In a narrow sense, the dust storage 502 may be a space between the outer surface of the second cyclone 130 and the inner surface of the dust collecting body 510 on a horizontal cross-sectional view. In this case, the suction pipe 5 may be in the form of a hole provided in the upper part of the dust collecting body 510.

Figure 11:
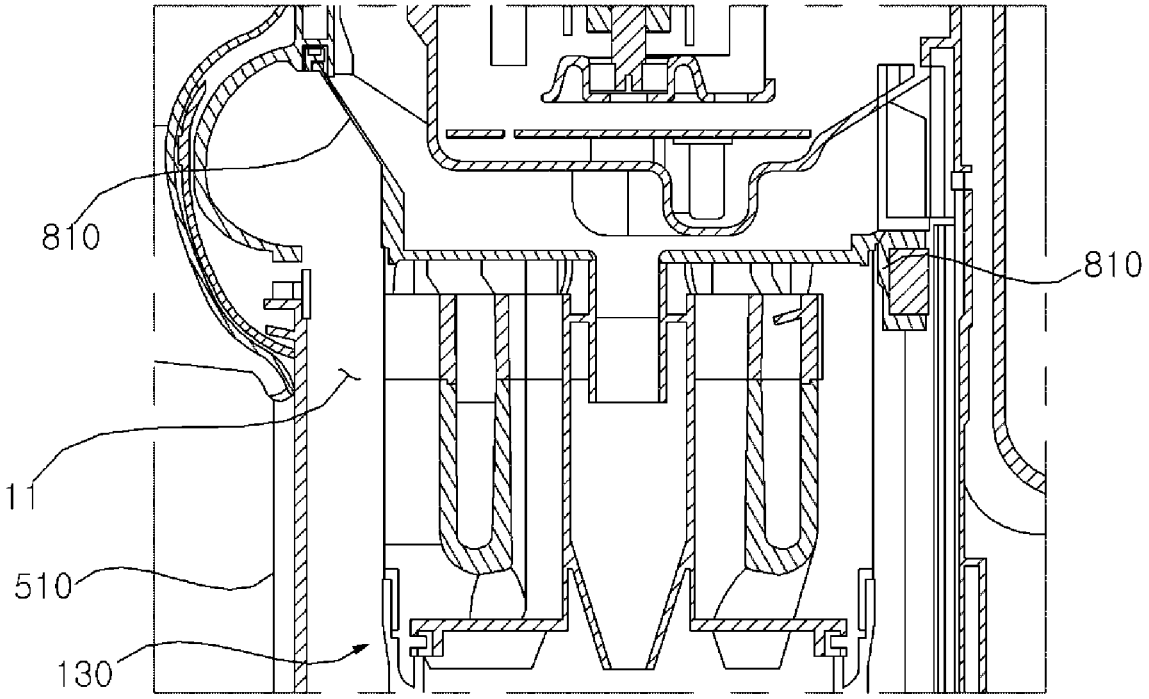
FIG. 11 is a broken-out section view of the cleaner of FIG. 3 taken along line A-A.
Figure 12:
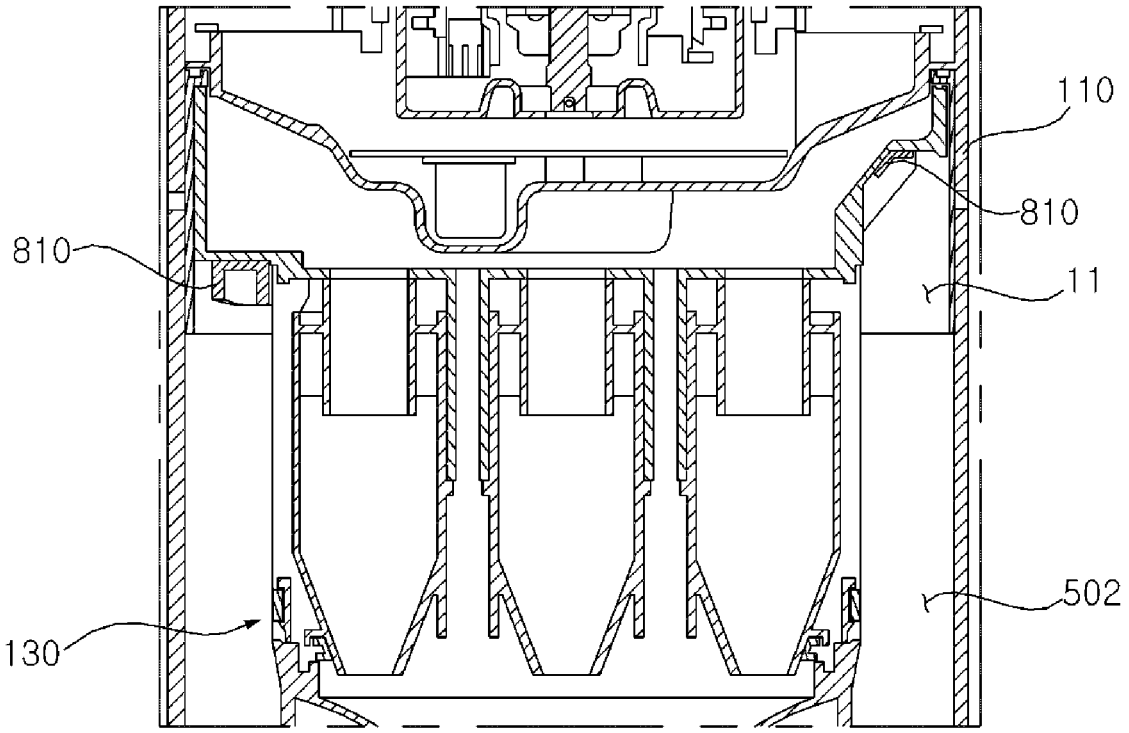
FIG. 12 is a broken-out section view of the cleaner of FIG. 3 taken along line B-B.

In another example, as illustrated in FIGS. 6, 11, and 12, the cyclone may include the first cyclone 110 and the second cyclone 130, the dust collecting body 510 of the dust container 50 may surround the second cyclone 130, and the upper part of the dust collecting body 510 may communicate with the first cyclone 110. Specifically, the first cyclone 110 and the dust collecting body 510 connected to the lower end of the first cyclone 110 may define a circular-shaped space, and the second cyclone 130 may be provided in the first cyclone 110 and the dust collecting body 510. More specifically, the upper part of the second cyclone 130 may be provided in the first cyclone 110, and the lower part of the second cyclone 130 may be provided inside the dust collecting body 510.

A flow space 11 may be defined between an inner circumferential surface of the first cyclone 110 and an outer circumferential surface of the second cyclone 130. That is, the flow space 11 may be defined as a space between the first cyclone 110 and the second cyclone 130 on a horizontal cross-section. The air flow space 11 may communicate with the upper part of the dust storage 502 and may vertically overlap the upper part of the dust storage 502. When the first cyclone 110 and the second cyclone 130 are provided, the dust storage 502 may be a dust storage 502 of the narrow sense.

When the upper part of the dust container 50 acts as a cyclone, the cleaning compressor 900 may move upward and downward in the dust container 50. In another example, when the first cyclone 110 and the second cyclone 130 are provided, the cleaning compressor 900 may reciprocate between the flow space 11 and the dust storage 502. The cleaning compressor 900 may move from the flow space 11 to the dust storage 502.

In order to bring an initial position of the cleaning compressor 900 in close contact with the top surface of the flow space 11 of the first cyclone 110, the cleaning compressor 900 may be restrained in a forcibly fitted manner by a protrusion protruding inwardly from an elastic member or from a dust collecting protrusion. The cleaning compressor 900 may return back to its initial position by the elastic member. An area of the cleaning compressor 900 as viewed from above may have a predetermined difference from an area which is obtained by subtracting an area of the second cyclone 130 from the dust collecting body 510.

Hereinafter, the cleaner of the present disclosure will be described on the assumption that the cleaner includes the first cyclone 110 and the second cyclone 130. A structure of the cleaning compressor 900 will be described in more detail with reference to FIG. 14. The movement unit may move the cleaning compressor 900. The movement unit may move the cleaning compressor 900 by electrical energy or by human force.

By moving the cleaning compressor 900, the movement unit may compress dust existing between the cleaning compressor 900 and the inner surface of the dust container 50. The movement unit may move the cleaning compressor 900 such that the cleaning compressor 900 is initially brought into close contact with the top surface of the flow space 11 of the first cyclone 110, and, in a procedure of compressing dust, the cleaning compressor 900 moves downward from the top surface such that dust existing between the body cover 520 and the cleaning compressor 900 is compressed.

For example, the movement unit may include a wire 830, a lever 840, and a return spring 850. The return spring 850 may be connected to the cleaning compressor 900 to provide an elastic force to return the cleaning compressor 900 back to its initial position. The return spring 850 may provide an elastic force in an upward direction so as to bring the cleaning compressor 900 into contact with the upper end of the flow space 11. By the elastic force of the return spring 850, the cleaning compressor 900 having moved downward may return back to its initial position.

A first end of the return spring 850 may be connected to the cleaning compressor 900 and a second end of the return spring 850 may be located over the cleaning compressor 900. The return spring 850 may be composed of a spiral spring.

A first end of the wire 830 may be connected to the cleaning compressor 900, and a second end of the wire 830 may be exposed to an outside of the dust container 50. Accordingly, a user may pull the wire 830, so as to move the cleaning compressor 900 downward. Since the wire 830 connects the cleaning compressor 900 and the lever 840 and is deformed flexibly, the wire 830 may be used even when a moving direction of the cleaning compressor 900 and a moving direction of the lever 840 are different.

The movement unit may further include a conversion guide (or guide groove) 820 which guides movement of the wire 830, and which converts a moving direction of the wire 830 from the vertical direction into a direction transverse to the vertical direction (hereinafter, referred to as a horizontal direction). In the case where the wire 830 moves freely, where the lever 840 moves in a direction transverse or opposite to a direction of the movement unit, or where the wire 830 moves, the cleaning compressor 900 may not move. Accordingly, although the wire 830 moves in a direction identical or different from a moving direction of the cleaning compressor 900, the cleaning compressor 900 may be allowed to move in the upward-downward direction due to the conversion guide 820.

The guide groove 820 may include: a first guide (or first guide groove) 821 that extends in the vertical direction and guides the wire 830 in the vertical direction; and a second guide (or second guide groove) 822 that extends in a direction transverse to the vertical direction and guides the wire 830 in the direction transverse to the upward-downward direction. The first guide 821 may extend to the lower end of the dust collecting body 510 in the flow space 11 of the first cyclone 110. A length of the first guide 821 is not limited, but the first guide 821 may extend from the lower end to the upper end of the dust collecting body 510.

The first guide 821 may include a vertical groove 821*a* that extends in the vertical direction. The wire 830 may be received in the vertical groove 821*a* to be guided.

The second guide 822 may extend in a horizontal direction. The second guide 822 may include a horizontal groove 822*b* that extends in the horizontal direction. A first end of the horizontal groove 822*b* may communicate with the lower end of the vertical groove 821*a*. Accordingly, the wire 830 may be received in the horizontal groove 822*b* to be guided.

A roller that reduces friction between the wire 830 and a guide groove may be provided at a corner where the horizontal groove 822*b* and the vertical groove 821*a* meet each other. The conversion guide 820 may be formed integrally with the dust connecting body 510. Alternatively, the conversion guide 820 may be coupled to the inner surface of the dust collecting body 510 so that a guide groove of the conversion guide 820 is covered by one surface of the dust collecting body 510.

The lever 840 may be connected to the second end of the wire 830 and may be greater in width, size, or height than the wire 830. Since it may be difficult for a user to pull the wire 830 with his/her hand due to a small diameter of the wire 830, the wire 830 may be easily pulled with a small force.

The lever 840 may be slidably provided on an outer surface of the dust collecting body 510. A sliding direction of the lever 840 may not be limited. However, the cleaning compressor 900 may move a distance close to a height of the dust collecting body 510. Accordingly, if the lever 840 moves in the vertical direction on the outer surface of the dust collecting body 510, a moving distance of the dust collecting body 510 may be restricted and it may be difficult to open the body cover 520 by pulling the lever 840 while holding the handle. Accordingly, the lever 840 may be located on the outer surface of the dust collecting body 510 and may be configured to slide in the horizontal direction. Specifically, the lever 840 may move below the dust collecting body 510 along the circumferential surface of the dust collecting body 510.

To guide movement of the lever 840, a slider (or slide rail) 511 may be formed in the dust container 50.

The slide rail 511 may allow the lever 840 to be restrained in the dust collecting body 510 while moving on the outer surface of the dust collecting body 510. The slide rail 511 may be a T-shaped groove which is formed as a recess in the outer surface of the dust collecting body 510, or may be a component separate from the dust collecting body 510.

The slide rail 511 may extend on the outer surface of the dust container 50 along a circumferential direction having a central axis in the vertical direction. Specifically, the slide rail 511 may extend in the circumferential direction along the circumferential surface of the dust collecting body 510. In another example, the slide rail 511 may extend in a direction transverse to the vertical direction which is a moving direction of the cleaning compressor 900.

Since the slide rail 511 extends in the horizontal direction, a user is able to hold the handle with one hand and move the lever 840 with the other hand in the horizontal direction. While doing so, the user is able to press the opening button 881*a* and 881*b* with the lever 840 to compress dust and open the body cover 520.

The lever 840 may slide into the slide rail 511 to thereby press the opening buttons 881*a* and 881*b*. The opening buttons 881*a* and 991*b* may be provided on a moving path of the lever 840. Specifically, the slide rail 511 may be provided in the dust collecting body 510 to be adjacent to the lower end of the dust collecting body 510, and a part of the opening buttons 881*a* and 881*b* may be provided at the same height as that of the slide rail 511. The opening buttons 881*a* and 881*b* may be provided such that at least a part of at least one of the opening buttons 881*a* and 881*b* overlaps the lever 840 and the slide rail 511 in the horizontal direction.

A first end of the slide rail 511 may be spaced apart from one of the opening buttons 881*a* and 881*b* and adjacent to the conversion guide 820, and a second end of the slide rail 511 may be provided such that at least a part thereof overlaps the initial position of the opening button 881 in the vertical direction. The initial position of the opening button 881 is a state before the opening buttons 881*a* and 881*b* are pressed by an external force.

Figure 10:
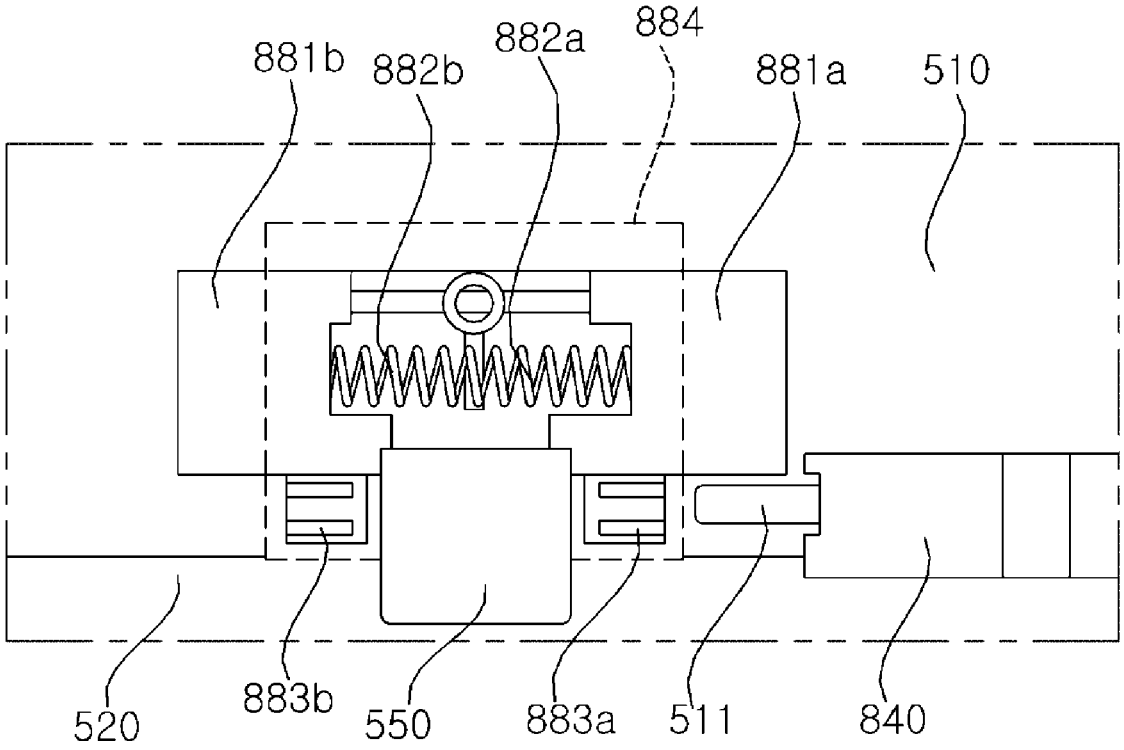
FIG. 10 is a diagram illustrating a lever and a fastening unit according an embodiment of the present disclosure.

With reference to FIG. 10, the fastening member 880 will be described in more detail. The fastening unit (or latch) 880 may be provided at the lower end on an outer circumferential surface of the dust collecting body 510. Specifically, the latch 880 may include: a fastening body 884; an elastic portion received in the body to allow the opening button 881 return back to its initial position; and the opening button 881 configured to be allowed to enter into the fastening body 884.

The opening button 881 may include a first opening button 881*a* and a second opening button 881*b* provided in both sides of the fastening body 884, or may be provided only in a left side adjacent to the lever 840. The opening buttons 881*a* and 881*b* receive an elastic force from an elastic member 882*a* and 882*b* in a direction distal from the fastening body 884. The opening button 881*a* and 881*b* moves in the horizontal direction.

A releaser for releasing the coupling of the coupling lever 550 to the dust collecting body 510 may be formed in the opening button 881. When the opening button 881 moves by an external force, the releaser is inserted into a space between the coupling lever 550 and the dust collecting body 510, thereby releasing the coupling of the coupling lever 550.

To open the body cover 520 of the dust container 50, a user may hold and press the first and second opening buttons 881*a* and 881*b* with a thumb and an index finger. To compress dust and open the body cover 520, the user may hold the left side of the fastening body 884 and the lever 840 with the thumb and the index fingers, and then push the lever 840 toward the first opening button 881*a*.

Referring to FIGS. 14A to 14G, the cleaning compressor 900 may have a shape such that the cleaning compressor 900 compresses dust existing in the flow space 11 and the dust storage area and removes foreign substances encountered by the dust storage, without disturbing a cyclonic airflow. That is, the cleaning compressor 900 may have a shape that corresponds to at least the flow space 11 from a direction of the airflow axis A1.

As viewed from a horizontal cross-section, the cleaning compressor 900 have a shape and size equal to those of the flow space 11 and the dust storage 502. That is, as viewed from above, the cleaning compressor 900 may have a shape and a size to entirely overlap the flow space 11. In another example, in order to reduce friction, the cleaning compressor 900 have a shape equal to that of the flow space 11 and has a size smaller than that of the flow space 11.

For example, the cleaning compressor 900 may include a base member 910 that defines a closed loop on a surface transverse to an upward-downward or vertical (airflow axis A1) direction. The base member 910 may be in a ring shape that surrounds the airflow axis A1 of the first cyclone 110 and the second cyclone 130.

All surfaces of the base member 910 may be arranged on the same horizontal line, but may have a helical shape corresponding to a shape of an upper part of the first cyclone 110 without disturbing a cyclonic airflow by the cleaning compressor 900. If the base member 910 has the above-described shape, the cleaning compressor 900 may be brought into contact with the upper part of the first cyclone 110 and a cyclonic airflow of the first cyclone 110 may be induced by a lower surface of the cleaning compressor 900.

Figure 14A:
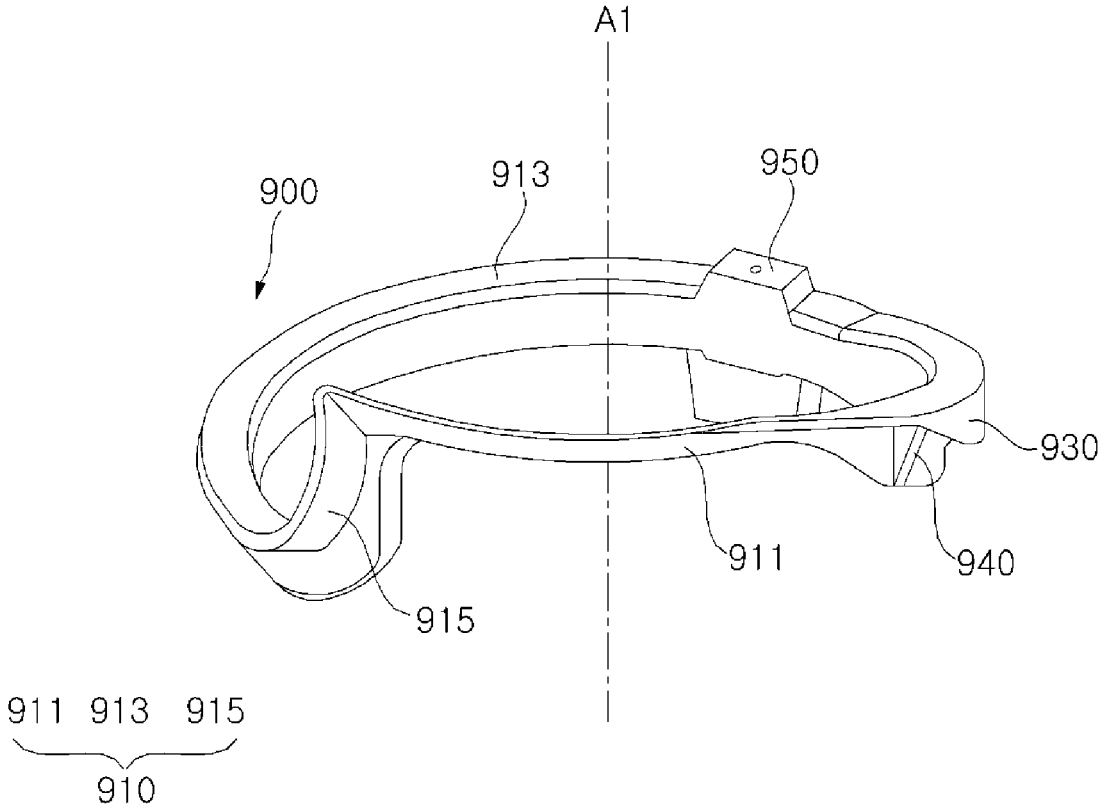
FIG. 14A is a perspective view of a cleaning compressor according to an embodiment of the present disclosure.
Figure 14B:
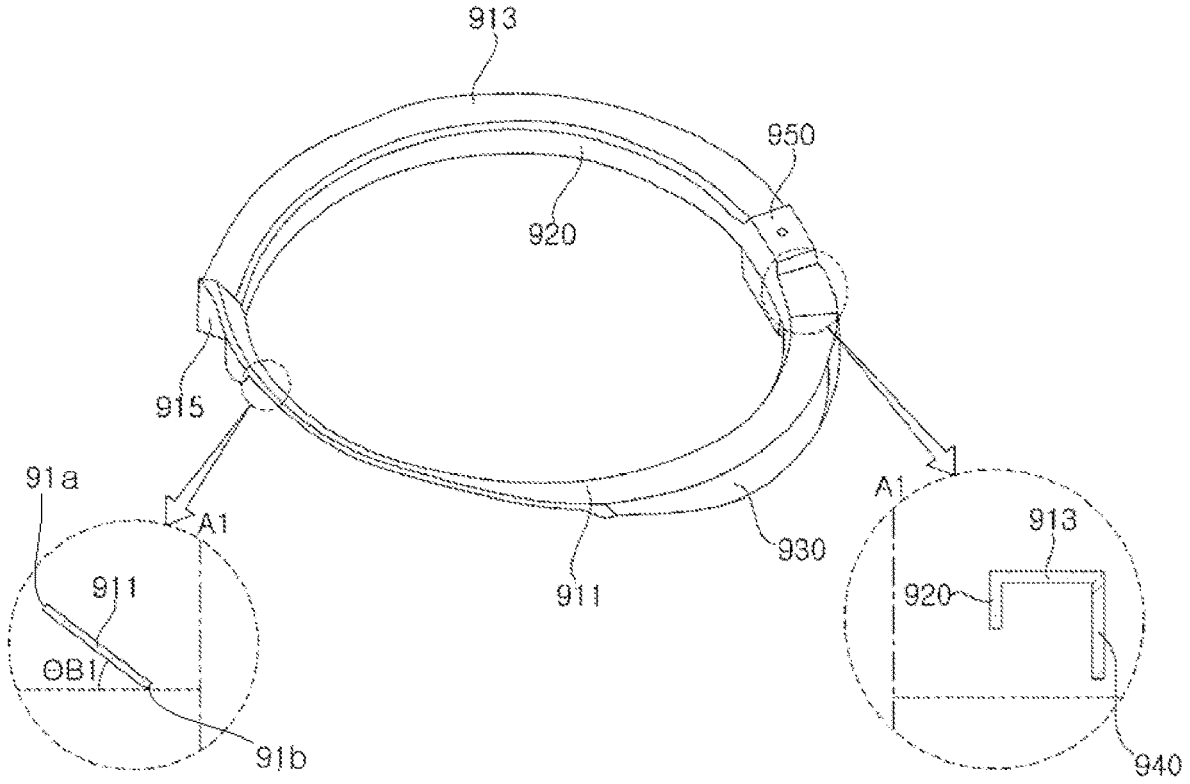
FIG. 14B is a perspective view of a cleaning compressor in a direction different from FIG. 14A according to an embodiment of the present disclosure.
Figure 14C:
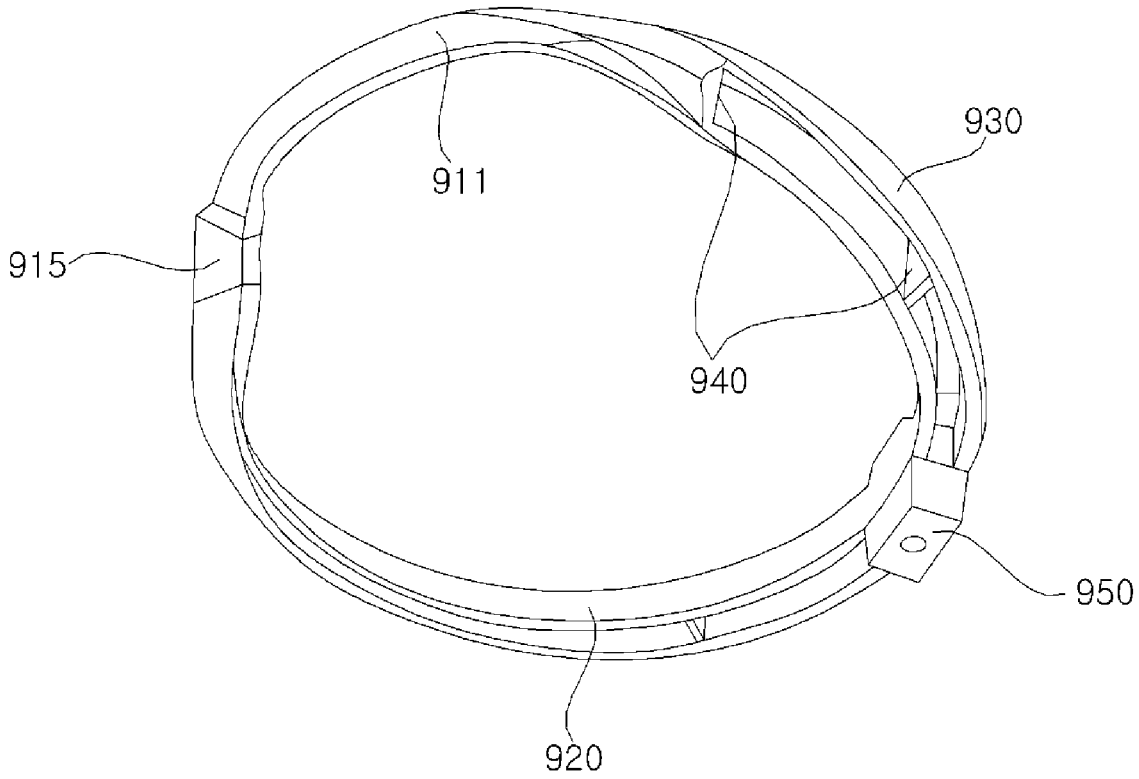
FIG. 14C is a perspective view of a cleaning compressor in a direction different from FIG. 14A and FIG. 14B according to an embodiment of the present disclosure.
Figure 14D:
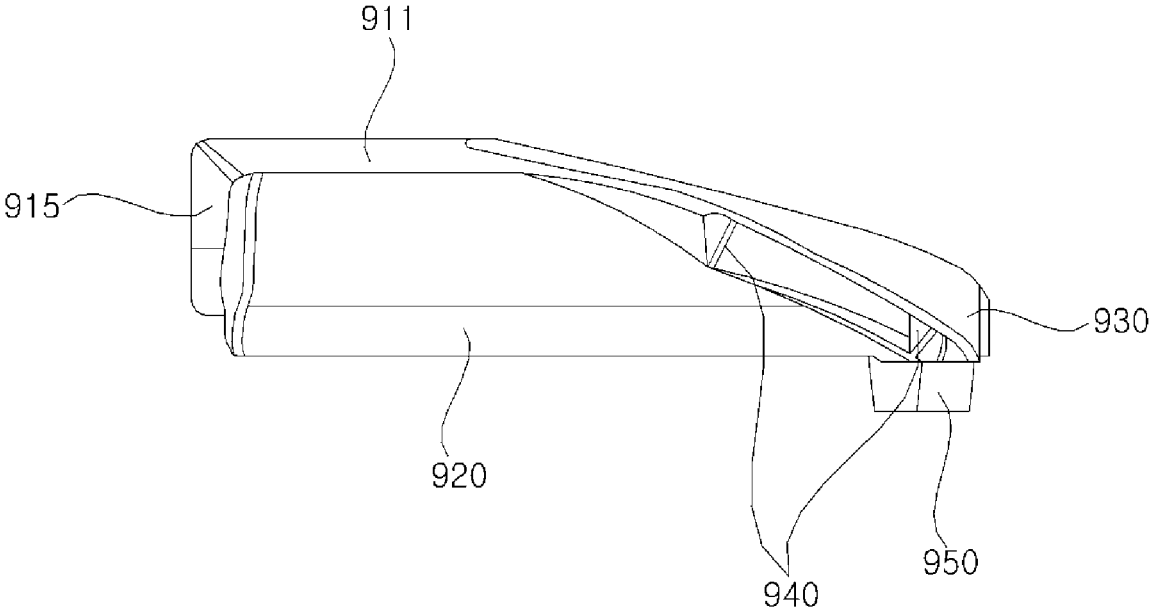
FIG. 14D is a side view of a cleaning compressor according to an embodiment of the present disclosure.
Figure 14E:
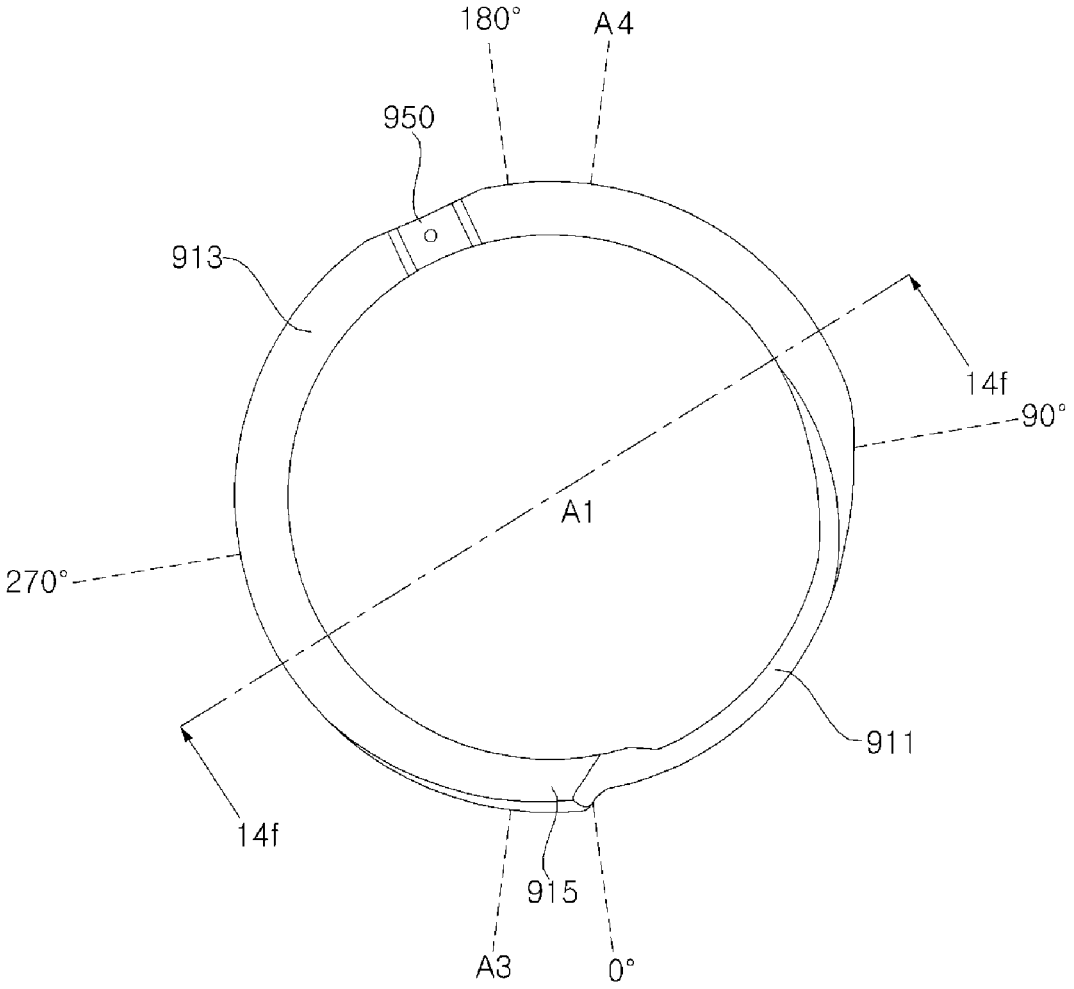
FIG. 14E is a plan view of a cleaning compressor according to an embodiment of the present disclosure.
Figure 14F:
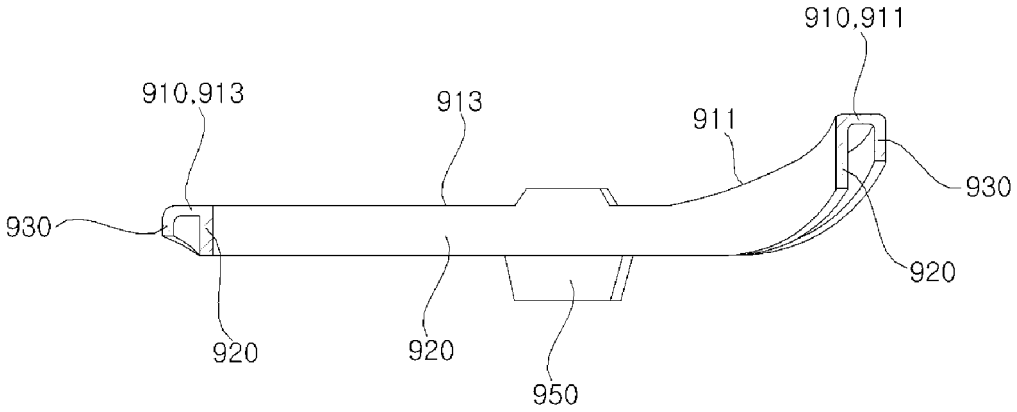
FIG. 14F is a cross-sectional view taken along line 14*f* in FIG. 14E.
Figure 14G:
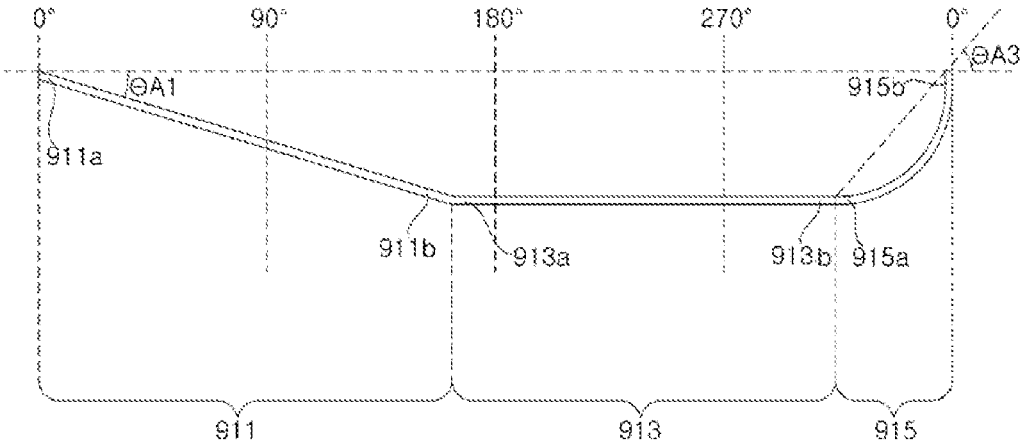
FIG. 14G is a diagram illustrating a height of a base member along a circumferential direction of a cleaning compressor according to an embodiment of the present disclosure.

The base member 910 may have a plurality of portions divided along a circumferential direction about the airflow axis A1, and at least one of the plurality of portions may be inclined downward along the circumferential direction. Referring to FIGS. 14E to 14G, the base member 910 may be divided into a first base portion 911, a second base portion 913, and a third base portion 915 along the circumferential direction about the airflow axis A1. A right end 911*b* of the first base portion 911 may be connected to a left end 913*a* of the second base portion 913, a left end 911*a* of the first base portion 911 may be connected to a right end 915*b* of the third base portion 915, and a right end 913*b* of the second base portion 913 may be connected to a left end 915*a* of the third base portion 915. The first base portion 911, the second base portion 913, and the third base portion 915 may collectively define a ring shape.

Herein, a line connecting boundaries of the first base portion 911 and the third base portion 915 may be defined as being at 0°, and the inscribed angles of 90°, 270°, and 360° may be defined in counter-clockwise rotation from 0° when viewed from above of the airflow axis A1. A boundary between the first base portion 911 and the third base portion 915 may be positioned at 0° in the circumference about the airflow axis A1, a boundary between the first base portion 911 and the second base portion 913 may be positioned between 170° and 190° in the circumference about the airflow axis A1, and a boundary between the second base portion 913 and the third base portion 915 may be positioned between 330° and 350° in the circumference about the airflow axis A1.

At the boundary between the first base portion 911 and the third base portion 915, the base member 910 may be adjacent to the suction pipe 5 such that air suctioned through the suction pipe 5 is rotated in a counterclockwise direction about the airflow axis A1 to thereby generate a downward airflow. If air suctioned through the suction pipe 5 into the flow space 11 is initially controlled to flow in a counter-clockwise and downward direction, the air may thereafter flow with inertia and thus it may not be necessary to control the direction of air later.

Thus, the first base portion 911 of the base member 910 may be inclined downward along the circumferential direction about the airflow axis A1. The circumferential direction may indicate a direction of rotation in a counter-clockwise direction, as viewed from above about the airflow axis A1. An inclination of the first base portion 911 may be defined as a first circumferential inclination angle ΘA1. The first circumferential inclination angle ΘA1 may indicate an angle between a virtual line connecting both ends of the first base portion 911 and a horizontal surface.

The first base portion 911 may be inclined downward gradually or at a predetermined gradient from the circumferential direction. A height of the left end 911*a* of the first base portion 911 may be higher than the right end 911*b* of the first base portion 911*a* and equal to a height of the right end 915*b* of the third base portion 915.

Air suctioned through the suction pipe 5 may flow from the front to the rear of the dust collecting body 510 or may flow from the front to the rear of the dust collecting body 510 while being inclined leftward. In order to more efficiently induce an airflow to descend while rotating in the flow space 11, at least a part of the first base portion 911 may be inclined downward from an outward side toward the airflow axis A1.

The first base portion 911 may include an inner circumferential surface 91*b* relatively adjacent to the airflow axis A1 compared to an outer circumferential surface 91*a* of the first base portion 911, and at least a part of the first base portion 911 may have a central inclination angle ΘB1 that is inclined downward from the outer circumferential surface toward the inward circumferential surface. The central inclination angle ΘB1 of the first base portion 911 may be an angle between the first base portion 911 and a horizontal surface perpendicular to the airflow axis A1 on a cross-sectional surface passing through the airflow axis A1.

The first base portion 911 may be entirely inclined. Alternatively, considering contact with an upper surface of the flow space 11 and a thickness of the cleaning compressor 900, only a part of the first base portion 911 may be inclined. An area of an inscribed angle between 0° and 80° or between 0° and 90° in the first base portion 911 may have a central inclination angle. A central inclination angle of the left end 911*a* of the first base portion 911 may be greater than a central inclination angle of the right end 911*b* of the first base portion 911. The central inclination angle of the right end 911*b* of the first base portion 911 may be 0°.

Air suctioned through the suction pipe 5 toward the airflow axis A1 may move downward due to the central inclination angle of the first base portion 911 and descend while rotating in a counter-clockwise direction due to the circumferential inclination angle of the first base portion 911. The first base portion 911 may form an airflow that moves downward while rotating. In order not to disturb air suctioned through the suction pipe 5, the center inclination angle of the first base portion 911 may reinforce rigidity of the first base portion 911.

If the entire base member 910 is continuously inclined downward along the circumferential direction, a vertical thickness of the cleaning compressor 900 may be increased and thereby a capacity of the dust container may be reduced, and, furthermore, an efficiency of compression of dust may be degraded due to a height of the first base portion 911.

To address this problem, the second base portion 913 may have a smaller inclination than an inclination of the first base portion 911 and an inclination of the third base portion 915. Heights of the left end 913*a* and the right end 913*b* of the second base portion 913 may be equal to a height of the right end 911*b* of the first base portion 911 and a height of the left end 915*a* of the third base portion 915, which may be equal.

In order to reduce a height of the cleaning compressor 900, the second base portion 913 may be parallel to a horizontal surface in the circumferential direction. Since the second base portion 913 may not contribute to a flowing direction of air entering through the suction pipe 5, the second base portion 913 may be parallel to the horizontal surface. Thus, the central inclination angle of the second base portion 913 may be 0°.

The third base portion 915 may connect the first base portion 911 and the second base portion 913 and may incorporate a step therebetween, and may guide air from the suction pipe 5 in a counter-clockwise direction. The third base portion 915 may guide the air, supplied from the suction pipe 5, to rotate around the airflow axis A1 of the first cyclone.

A length of the third base portion 915 may be smaller than a length of the first base portion 911 and a length of the second base portion 913. The length of the third base portion 915 may be smaller than the bore of the suction pipe 5.

The third base portion 915 may be inclined upward along the circumferential direction. An inclination of the third base portion 915 may be defined as a third circumferential inclination angle ΘA3. The third circumferential inclination angle ΘA3 may be greater than the first circumferential inclination angle ΘA1 and the second circumferential inclination angle.

The third base portion 915 may be inclined in a straight-line or curved form, and the circumferential inclination angle of the right end 915*b* of the third base portion 915 may be close to 90°. The third circumferential inclination angle of the third base portion 915 may be about 40° to 80°.

At least a part of the third base portion 915 may have a central inclination angle that is inclined downward from an outer circumferential surface toward an inner circumferential surface. As viewed on a horizontal cross-section, the base member 910 may have a shape and size equal to those of the flow space 11 and/or the dust storage 502, or may have a size smaller than those of the flow space 11 and the dust storage 502. The base member 910 may have a shape and size that entirely overlap the flow space 11, as viewed from above, or, in order to reduce friction, the cleaning compressor 900 may have a shape equal to that of the flow space 11 and a size or diameter smaller than that of the flow space 11.

Figure 13:
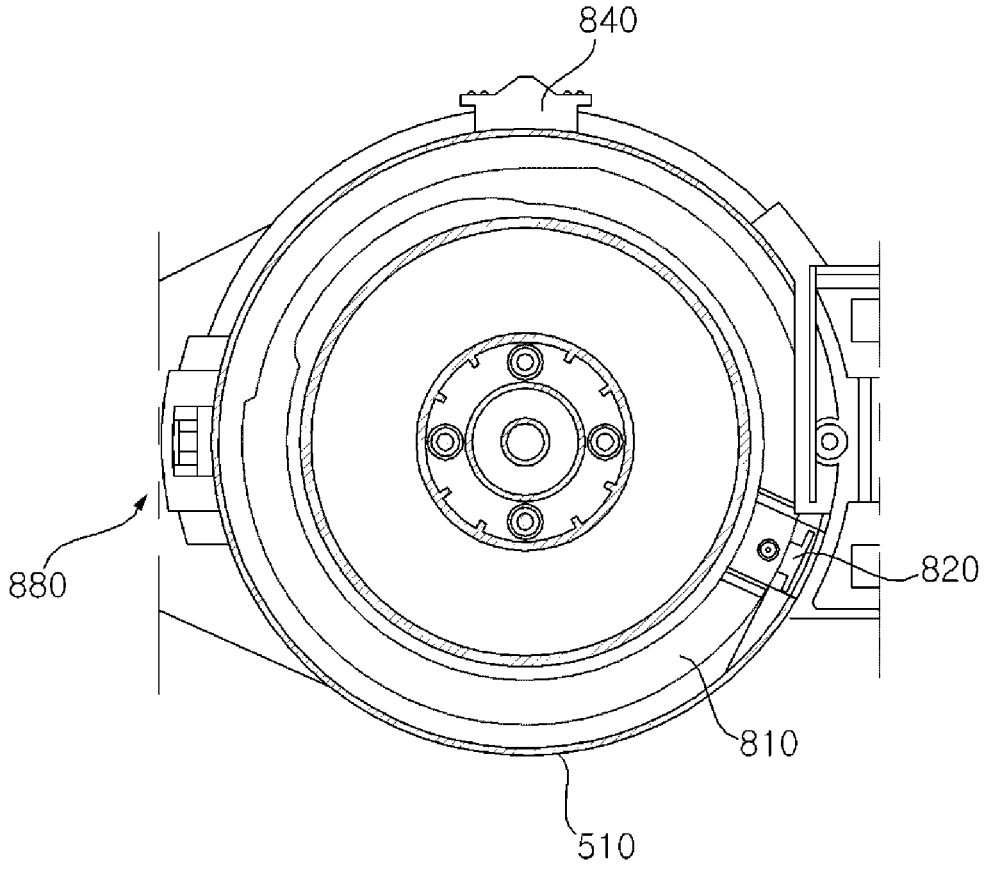
FIG. 13 is a horizontal cross-sectional view of a cleaner viewed from the bottom according an embodiment of the present disclosure.

As illustrated in FIG. 13, a gap between the inner circumferential surface 91*b* of the base member 910 and an outer circumferential surface of the second cyclone 130 may be smaller than a gap between the outer circumferential surface 91*a* of the base member 910 and an inner circumferential surface of the dust collecting body 510. With this structure, the cleaning compressor 900 may efficiently remove dust from the outer circumferential surface of the second cyclone 130.

At least a part of the inner circumferential surface 91*b* of the base member 910 may be located further from the outer circumferential surface of the second cyclone 130 than another part of the inner circumferential surface 91*b*. Specifically, at least a part of the inner circumferential surface of the first base portion 911 may be spaced apart outward from a circumference being sized with a first radius about the airflow axis A1, and the respective inner circumferential surfaces of the second base portion 913 and the third base portion 915 may be provided on the circumference being sized with the first radius. More specifically, an inner circumferential surface of an area of an inscribed angle between 0° and 90° may be spaced apart outward from the circumference being sized with the first radius from the airflow axis A1.

At least a part of the outer circumferential surface 91*a* of the base member 910 may be further from the outer circumferential surface of the dust collecting body 510 than another part of the outer circumferential surface 91*a*. Specifically, at least a part of the outer circumferential surface of the first base portion 911 may be spaced apart inward from a circumference being sized with a second radius about the airflow axis A1, and the respective outer circumferential surfaces of the second base portion 913 and the third base portion 915 may be provided on the circumference being sized with the second radius.

More specifically, an outer circumferential surface of an area of an inscribed angle between 0° and 90° in the first base portion 911 may be spaced apart inward from the circumference being sized with the second radius about the airflow axis A1. As the inner or outer circumferential surface of the first base portion 911 is spaced apart from the outer circumferential surface of the second cyclone 130 or from the dust collecting body 510, air suctioned through the suction unit 5 may enter through a gap therebetween.

A connector 950 to which the movement unit is connected may be further formed in the cleaning compressor 900. A wire may be connected to the connector 950, and the connector 950 may be thick enough to be resistant to tensile stress of the wire. The connector 950 may have a thickness greater than a thickness of the base member 910 and a vertical member which will be described later on.

The connector 950 may be provided at the second horizontal portion 913. In order to reduce interference with air suctioned through the suction pipe 5, the connector 950 may face the third base portion 915 with respect to the airflow axis A1. Foreign substances may be encountered when the cleaning compressor 900 moves upward and downward by the movement unit, so the cleaning compressor 900 may further include an inner lips member (or an inner lip) 920 to reinforce rigidity of the cleaning compressor 900 and to expand an area in contact with the outer surface of the second cyclone 130.

Figure 14H:
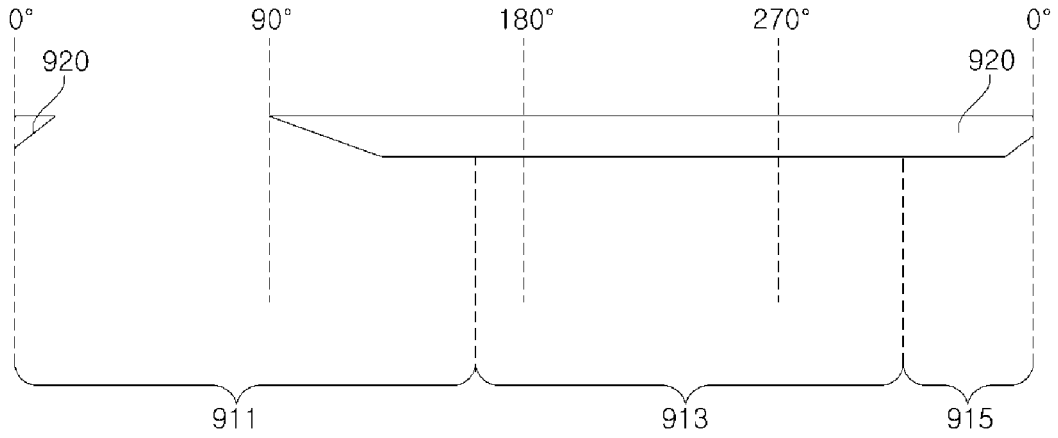
FIG. 14H is a diagram illustrating a thickness of an inner lips member along a circumferential direction of a cleaning compressor according to an embodiment of the present disclosure.

Referring to FIG. 14H, the inner lip 920 may extend downward from at least a part of the inner circumferential surface 91*b* of the base member 910. The inner lip 920 may reinforce rigidity of the cleaning compressor 900. The inner lip 920 may extend downward from the inner circumferential surface 91*b* of the base member 910. To avoid interference with the outer circumferential surface of the second cyclone 130 when the cleaning compressor 900 moves, the inner lip 920 may be parallel to the outer circumferential surface of the second cyclone 130 (or the airflow axis A1).

If the inner lip 920 is provided across the entire area of the base member 910, the inner lip 920 may disturb an airflow. Thus, the inner lip 920 may be formed only in a partial area along the inner circumferential surface 91*b* of the base member 910. Specifically, the inner lip 920 may be provided at a part of the first base portion 911, in the second base portion 913, or in the third base portion 915.

The inner lip 920 may not be provided at an area adjacent to the third base portion 915. The inner lip 910 may be provided in an area of an inscribed angle between 90° and 360° and between 0° and 10° in the base member 910. A thickness of the inner lip 920 adjacent to the left end 911*a* of the first base portion 911 may be thinner than a thickness of another part of the first base portion 911.

Figure 14I:
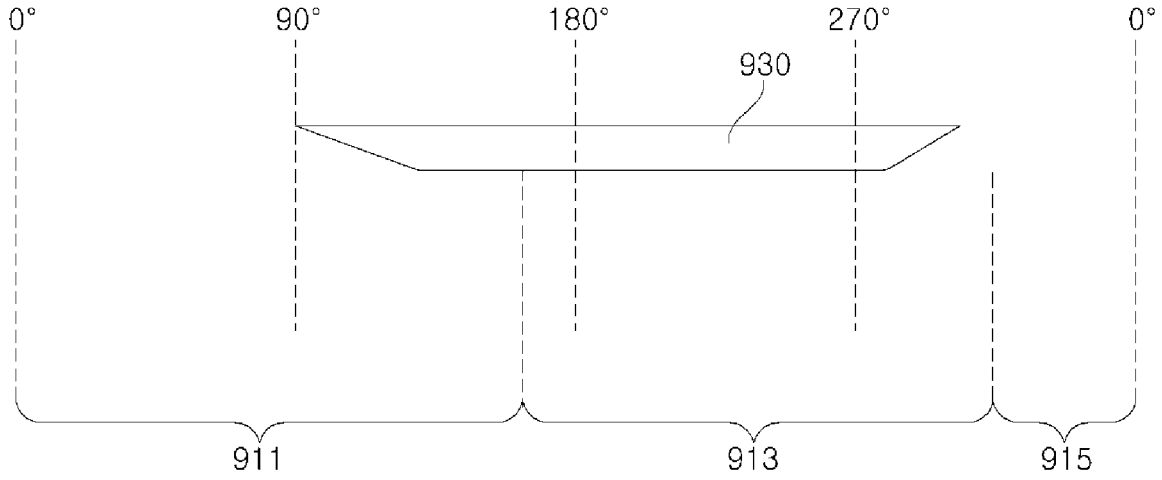
FIG. 14I is a diagram illustrating a thickness of an outer lips member along a circumferential direction of a cleaning compressor according to an embodiment of the present disclosure.

In order to reinforce rigidity thereof, the cleaning compressor 900 may further include an outer lips member (or outer lip) 930. Referring to FIG. 14*i*, the outer lip 930 may extend downward from at least a part of the inner circumferential surface 91*b* of the base member 910. The outer lip 930 may reinforce the rigidity of the cleaning compressor 900. The outer lip 930 may extend downward from the outer circumferential surface 91*a* of the base member 910. To avoid interference with the inner circumferential surface of the dust collecting body 510 when the cleaning compressor 900 moves, the outer lip 930 may be parallel to the outer circumferential surface of the dust collecting body 510 (or the airflow axis A1).

If the outer lip 930 is provided across the entire area of the base member 910, it may disturb air from flowing from the suction pipe 5 into the flow space 11. Thus, the outer lip 930 may be formed only at a part of the base member 910 along the circumferential surface 91*a* of the base member 910. The outer lip 930 may be provided at a part of the first base portion 911 and in a part of the second base portion 930.

The outer lip 930 may be provided at an area of the first base portion 911 adjacent to the second base portion 911 and an area of the second base portion 913 adjacent to the first base portion 911 across the entire area of the base member 911. The outer lips member 930 may be disposed in an area of an inscribed angle between 90° and 300° of the base member 910. A thickness of the outer lip 930 may be reduced in a direction from the center to both ends thereof.

In order to reinforce rigidity thereof, the cleaning compressor 900 may further include a central vertical member (or reinforcement rib) 940. The central vertical member 940 may be provided between the inner lip 920 and the outer lip 930 and may be connected to the inner lip 920, the outer lip 930, and the base member 910.

The central vertical member 940 may extend downward from the base member 910 and extend in a radial direction from the airflow axis A1. The central vertical member 940 may be provided as a plurality of central vertical members arranged at a predetermined interval along the circumferential direction.

Figure 14J:
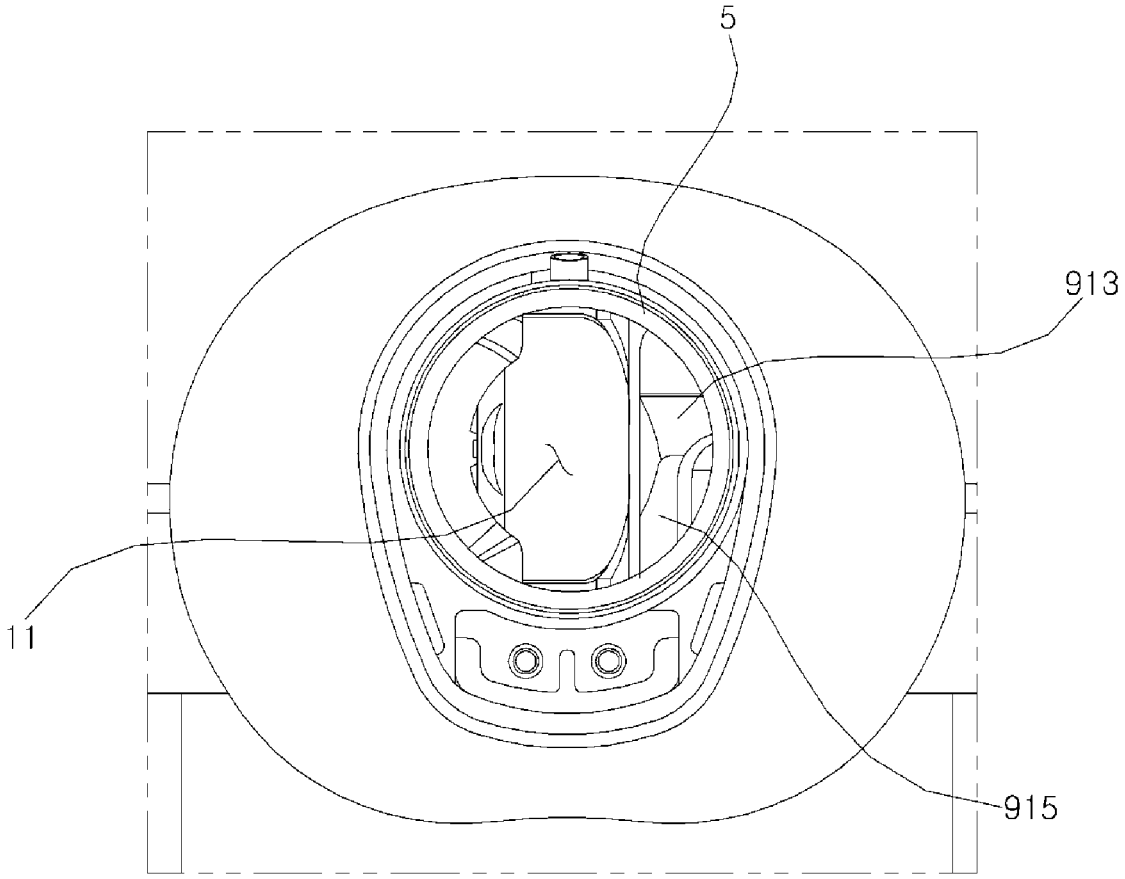
FIG. 14J is a diagram illustrating a positional relationship of a suction unit and a cleaning compressor as viewed from the front.
Figure 14K:
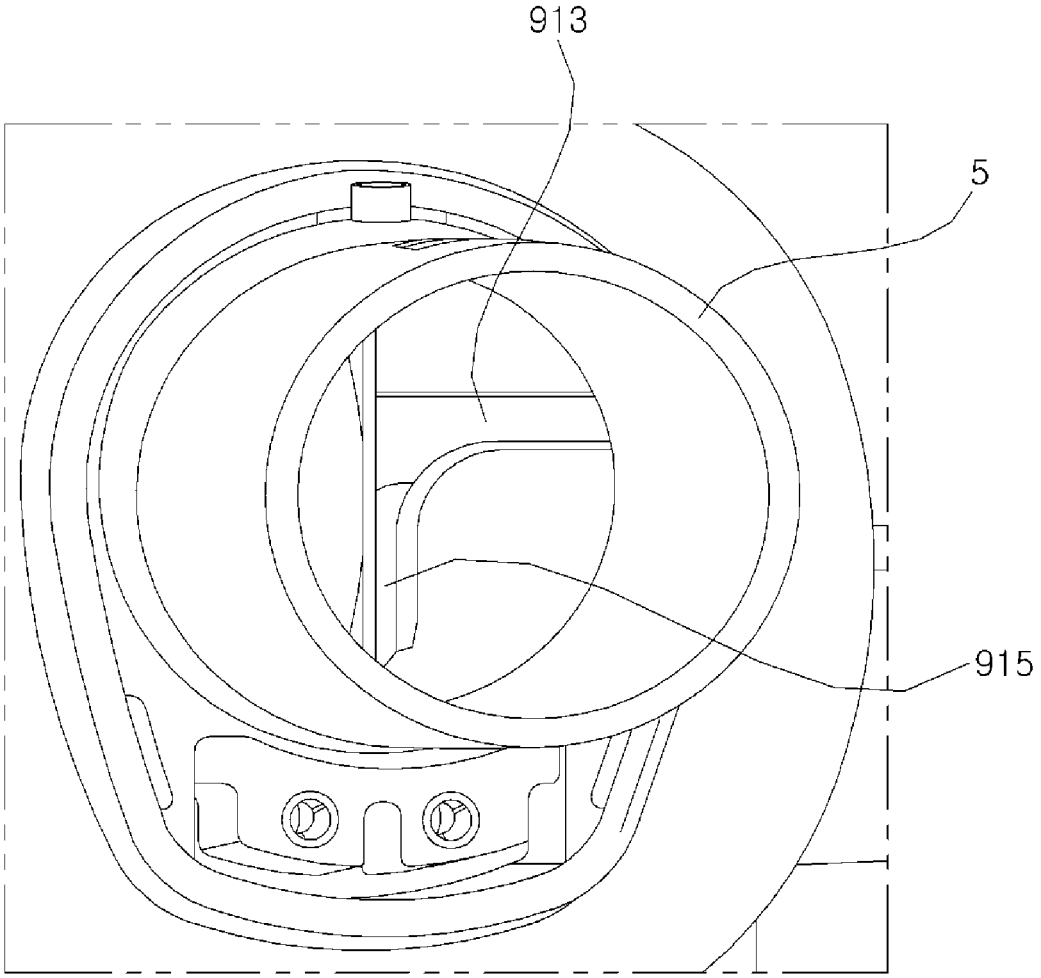
FIG. 14K is a diagram illustrating a positional relationship of a suction unit and a cleaning compressor as viewed from between the front and the right side.

Referring to FIGS. 14J and 14K, the third base portion 915 may be adjacent to the suction pipe 5 in order to allow air suctioned into the flow space 11 to flow cyclonically. At least a part of the third base portion 915 may overlap the suction pipe 5 in the front-rear direction. The third base portion 915 may be eccentric to a central line connecting the airflow axis A1 and the center of the suction pipe 5. The eccentric direction of the third horizontal direction 915 may be a rotation direction of a cyclone.

Figure 15:
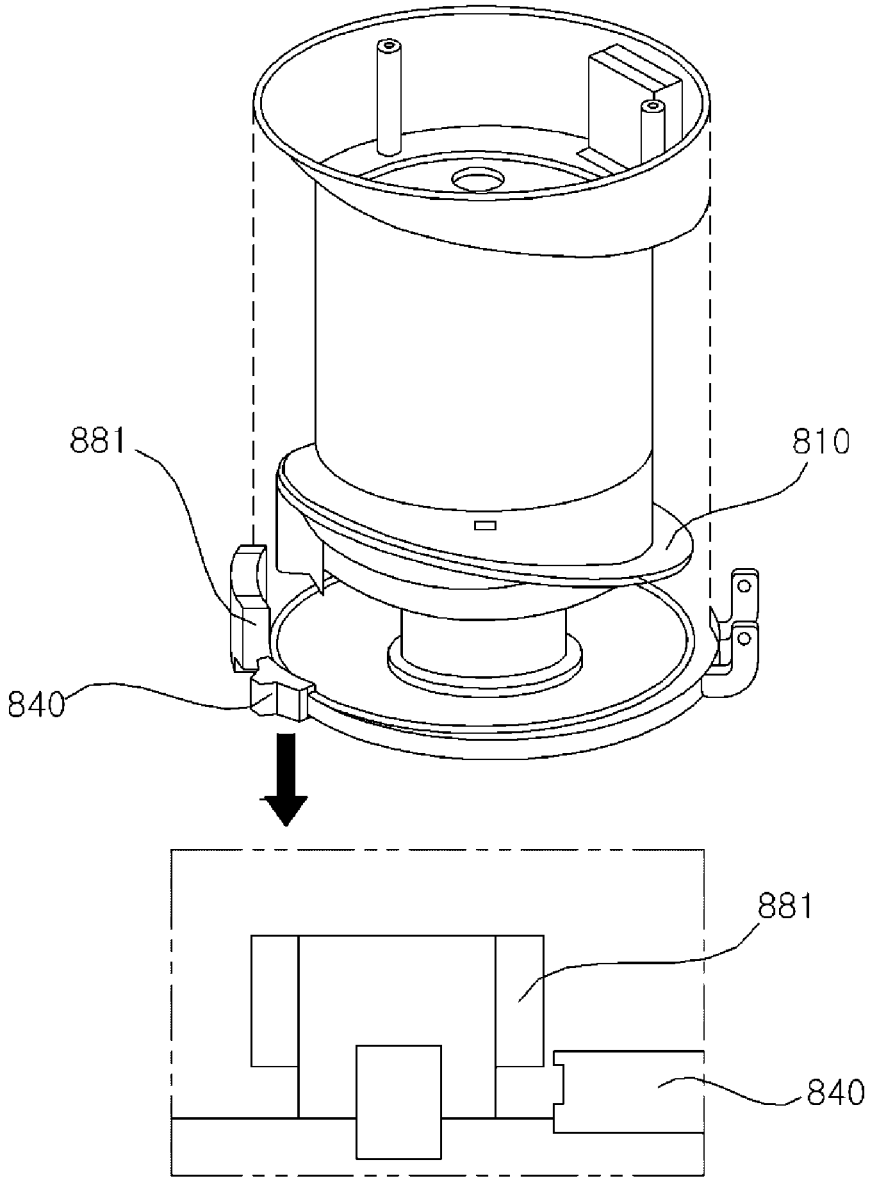
FIGS. 15 to 17 are diagrams illustrating an in-operation state of a cleaner according to an embodiment of the present disclosure.
Figure 16:
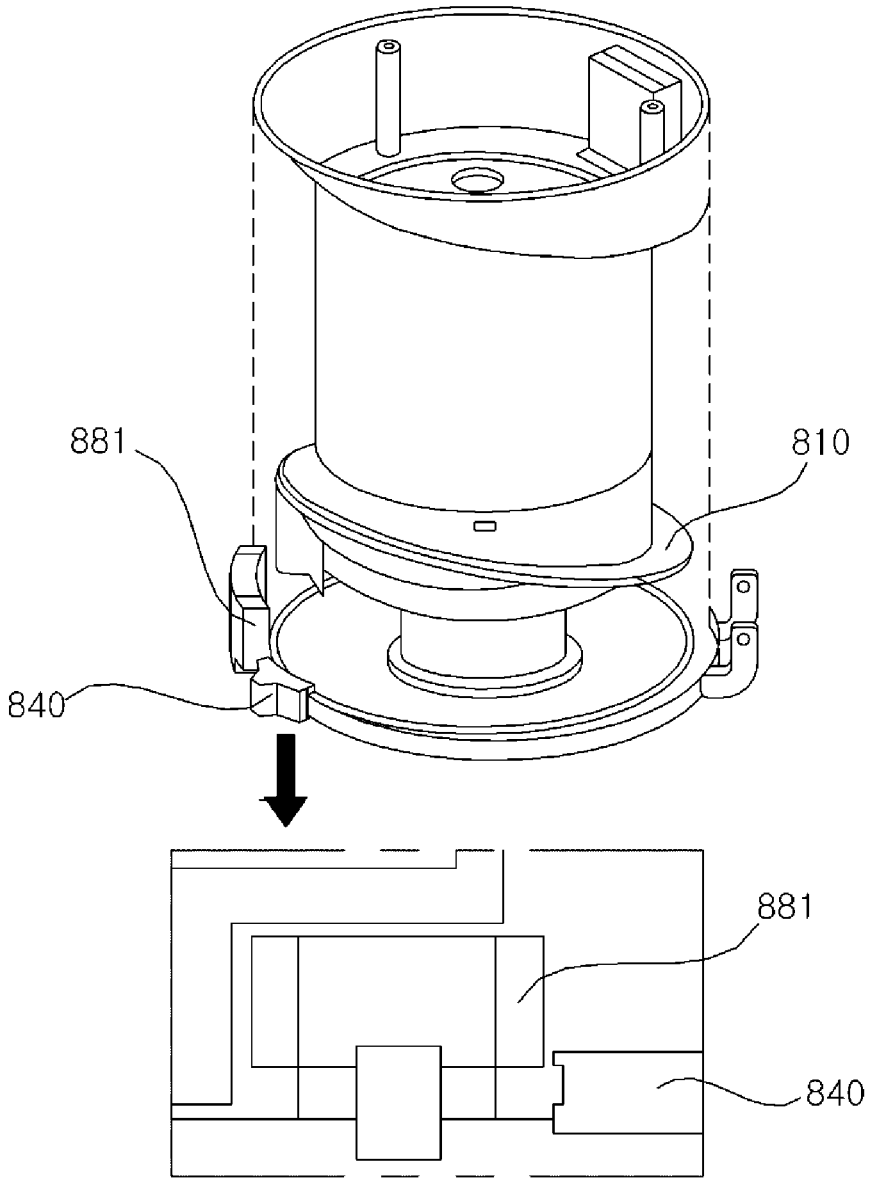
Figure 17:
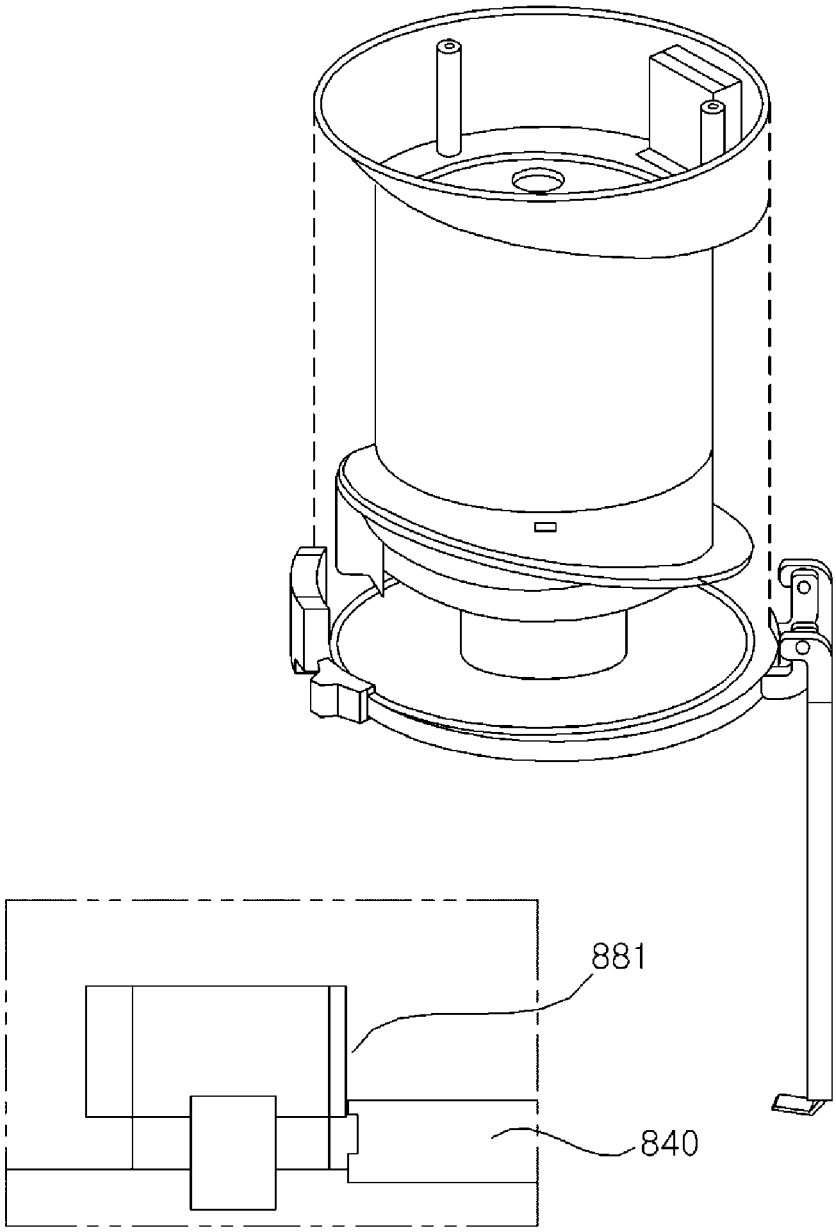
Figure 18:
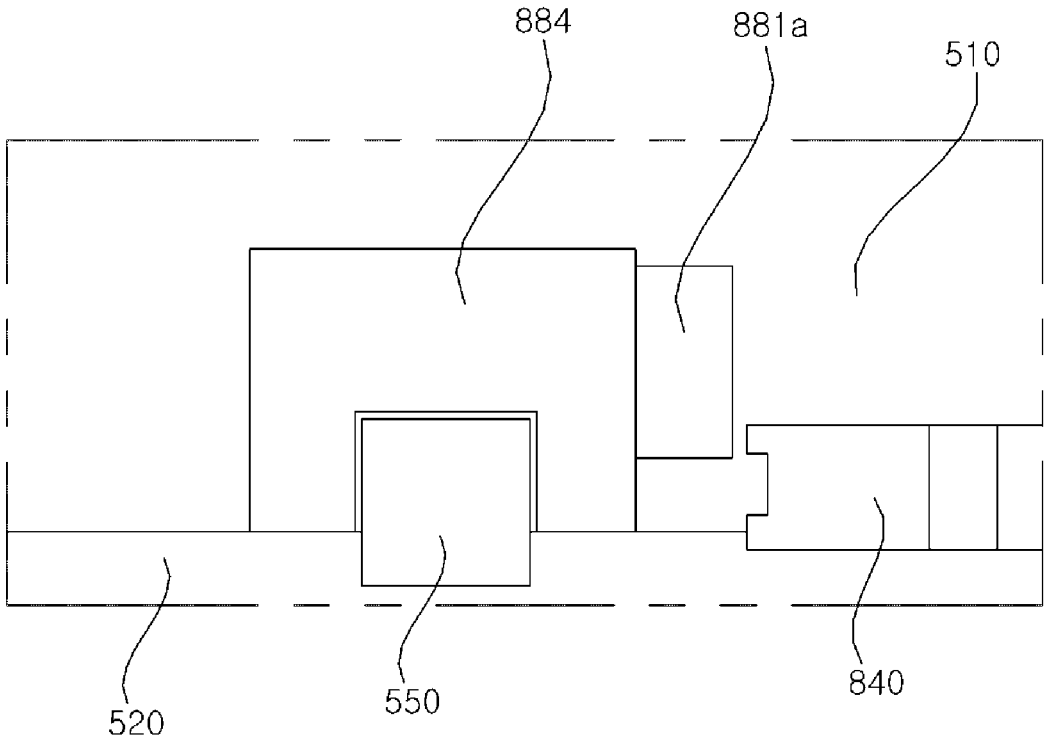
FIG. 18 is a diagram illustrating a fastening unit according to another embodiment of the present disclosure.

FIG. 15 shows that the cleaning compressor 900 is at an initial position, FIG. 16 shows that dust is compressed by the cleaning compressor 900, and FIG. 17 shows that the body cover 520 is opened in response to the opening button 881*a* and 881*b* being pressed by the lever 840. Referring to FIG. 15, the cleaning compressor 900 may contact the upper surface of the flow space 11 by an elastic force of the return spring 850. The cleaning compressor 900 may have a shape that induces air to flow cyclonically. Since the cleaning compressor 900 contacts the upper surface of the flow space 11, dust may be efficiently accumulated in the dust container 50 despite the presence of the cleaning compressor 900.

Referring to FIG. 16, when the dust is accumulated in the dust container 50, a user may rotate the lever 840 along a circumferential direction of the dust collecting body 510 to move the cleaning compressor 810 downward so as to compress the dust in the dust container 50. Referring to FIG. 17, when the lever 840 presses the opening button 881, the body cover 520 may be opened and a user may easily remove the compressed dust.

Compared to the embodiment of FIG. 10, a latch 880 according to another embodiment may be different in that an opening button 881 is installed only in one side. A first opening button 881*a* according to another embodiment may reciprocate from the fastening body 884 toward the lever 840. The first opening button 881*a* may protrude from the fastening body 884 toward the lever 840. A user may then be able to pull the lever 840 while holding the fastening body 884 positioned in the opposite side to the lever 840, and thus, it may be possible to prevent the body cover 520 from being opened before dust inside the dust container 50 is completely compressed.

Figure 19:
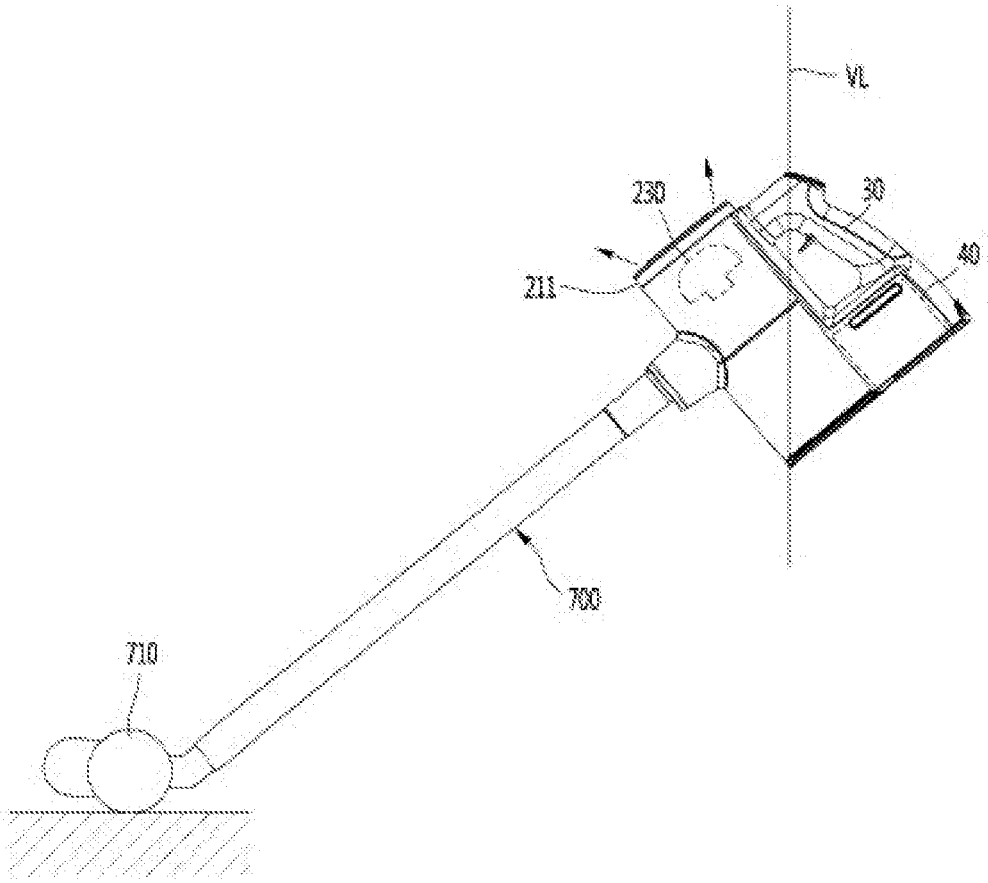
FIG. 19 is a diagram illustrating the case where a cleaner according to the present disclosure cleans a floor while a suction nozzle is connected to the cleaner.

Referring to FIG. 19, an extension pipe 700 connected to the bottom of a suction nozzle 710 may be connected to the suction pipe 5 of the cleaner 1 according to the present disclosure. With the suction nozzle 710 being placed on a floor, a user may perform cleaning by moving the suction nozzle 710. In the case where cleaning is performed using the suction nozzle 710 in the present disclosure, while an angle between a floor and a longitudinal axis of the extension pipe 700 or the suction pipe 5 is approximately 45 degrees, the cleaning may be performed by increasing or decreasing the angle.

According to the above solution, a cleaner according to the present disclosure has advantages that a user is allowed to easily remove dust collected in a dust container, that the dust is prevented from dispersing into the air when the user removes the dust from the dust container, and that dusts stuck onto an outer surface of a cyclone may be removed off.

In addition, the cleaner according to the present disclosure has an advantage that a lever for moving a cleaning compressor moves along a circumferential direction in a lower part of an outer surface of the dust container, and it is easy to use the cleaner because the lever does not move upward and downward on the outer surface of the dust container. In addition, the cleaner according to the present disclosure has an advantage that, since a moving path of the lever is longer than a height of the dust container, movement of the lever may apply a sufficient magnitude of pressure may be applied to dust.

In addition, the cleaner according to the present disclosure has an advantage that, since the cleaning compressor moves downward by a user's force to press dust in a direction toward the bottom surface of the dust container and the cleaning compressor returns back to its initial position by an elastic force, the cleaning compressor does not disturb a cyclonic flow of air suctioned through the suction unit and does not prevent dust from being collected in the lower part of the dust container.

In addition, the cleaner according to the present disclosure has an advantage that a large-sized foreign substance encountered by the upper end of the dust container or the suction unit may be easily removed.

In addition, the cleaner according to the present disclosure has an advantage that, since dust are suctioned and continuously compressed in the dust container, it is possible to secure an enough capacity of the dust container, maintain performance of a secondary cyclone, and remove a need of emptying the dust container frequently.

In addition, the cleaner according to the present disclosure has an advantage that, since an opening button for a door of the dust container is disposed on a moving path of the lever for moving the cleaning compressor, a user is able to compress dust in the dust container and open the door of the dust container subsequently while holding a side of the dust container opposite to the opening button and the lever with a thumb and an index finger.

One aspect of the present disclosure is to provide a cleaner which has a cleaning compressor in a shape with rigidity sufficient enough to compress dust, and which does not disturb a cyclonic airflow.

A cleaner may include: a dust separation unit comprising at least one cyclone for separating dust from suctioned air by centrifugation, and a flow space where air rotates about an axis of an airflow of the cyclone; a dust container storing dust separated by the dust separation unit, and comprising a dust storage communicating with the flow space; and a cleaning compressor reciprocating between the flow space and the dust storage, wherein the cleaning compressor comprises a base member that defines a closed loop on a surface transverse to the airflow axis, wherein the base member is composed of a plurality of portions divided along a circumferential direction about the airflow axis, at least one of the plurality of portions which is disposed to be inclined downward along the circumferential direction. The base member may be divided into a first base portion, a second base portion, and a third base portion along the circumferential direction about the airflow axis.

A right end of the first base portion may be connected to a left end of the second base portion, a left end of the first base portion may be connected to a right end of the third base portion, and a right end of the second base portion may be connected to a left end of the third base portion. The first base portion may be disposed to be inclined downward at a first circumferential inclination angle along the circumferential direction, and the third base portion may be disposed to be inclined upward at a third circumferential inclination angle greater than the first circumferential inclination angle along the circumferential direction.

The second base portion may have an inclination smaller than the first circumferential inclination angle and the third circumferential inclination angle. A height of the left end of the first base portion may be higher than a height of the right end of the first base portion and equal to a height of the right end of the third base portion. Heights of the left end and the right end of the second base portion may be equal to a height of the right end of the first base portion and a height of the left end of the third base portion.

The cleaner may further include a suction unit through which external air is suctioned into the dust separation unit, and the third base portion may be disposed adjacent to the suction unit. The third base portion may be disposed to be eccentric on a central line that connects the axis of the air flow and a center of the suction unit, and at least a part of the third base portion may be disposed to overlap the suction unit in a front-rear direction.

The first base portion may include an outer circumferential surface, and an inner circumferential surface relatively more adjacent to the airflow axis than the outer circumferential surface, and at least a part of the first base portion may have a central inclination angle that is inclined downward in a direction from the outer circumferential surface to the inner circumferential surface. A central inclination angle of a left end of the first base portion may be greater than a central inclination angle of a right end of the first base portion.

At least a part of the inner circumferential surface of the first base portion may be spaced apart outward from a circumference being sized with a first radius from the airflow axis. Inner circumferential surfaces of the second base portion and the third base portion may be positioned on the circumference being sized with the first radius from the airflow axis.

A boundary between the first base portion and the third base portion may be is positioned at 0° on a circumference about the airflow axis, a boundary between the first base portion and the second base portion may be positioned at between 170° and 190° on the circumference about the airflow axis, and a boundary between the second base portion and the third base portion may be positioned at between 330° and 350° on the circumference about the airflow axis.

The cleaning compressor may further include an inner lips member that extends downward from at least a part of an inner circumferential surface of the base member. The inner lips member may be disposed at a part of the first base portion, the second base portion, and the third base portion.

The cleaning compressor may further include an outer lips member that extends downward from at least a part of an outer circumferential surface of the base member. The vertical member may be disposed at a part of the first base portion and a part of the second base portion.

The cleaning compressor may include a connector to which a movement unit is connected, and the connector may be disposed to face the third base portion with reference to the airflow axis. The dust container may include a dust collecting body having an opened bottom and a cylindrical shape whose central axis is an upward-downward direction, and a body cover rotatably coupled to the bottom of the dust collecting body, the dust collecting body may be disposed to surround the dust separation unit on a surface transverse to an upward-downward direction, and a dust storage may be defined between an outer surface of the dust separation unit and an inner surface of the dust collecting body. The dust separation unit may include a first cyclone configured to separate dust by a cyclonic airflow, a second cyclone disposed inside the first cyclone, and a flow space between an inner circumferential surface of the first cyclone and an outer circumferential surface of the second cyclone, and the flow space may communicate with an upper part of the dust storage.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the present disclosure are described herein with reference to cross-section illustrations that are schematic illustrations of idealized embodiments (and intermediate structures) of the present disclosure. As such, variations from the shapes of the illustrations as a result, for example, of manufacturing techniques and/or tolerances, are to be expected. Thus, embodiments of the present disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the present disclosure. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the present disclosure, the drawings and the appended claims. In addition to variations and modifications in the component parts and/or arrangements, alternative uses will also be apparent to those skilled in the art.

What is claimed is:

1. A cleaner comprising:

at least one cyclone configured to separate dust from suctioned air and defining a flow space in which air rotates about an axis of the cyclone;

a dust container that stores dust separated by the cyclone and comprising a dust storage area that communicates with the flow space; and a dust compressor configured to reciprocate between the flow space and the dust storage area, wherein the dust compressor comprises a base ring that defines a closed loop perpendicular to an axis of the dust container, wherein the base ring is composed of a plurality of sections divided along a circumferential direction about the airflow axis, and wherein at least one of the plurality of sections is inclined downward along a circumferential direction.

2. The cleaner of claim 1, wherein the base ring is circumferentially divided into a first section, a second section, and a third section.

3. The cleaner of claim 2, wherein a first end of the first section is connected to a first end of the second section, wherein a second end of the first section is connected to a first end of the third section, and wherein a second end of the second section is connected to a second end of the third section.

4. The cleaner of claim 3, wherein a height of the second end of the first section is higher than a height of the first end of the first section and equal to a height of the first end of the third section.

5. The cleaner of claim 4, wherein heights of the first end and the second end of the second section are equal to the height of the first end of the first section and the height of the second end of the third section.

6. The cleaner of claim 2, wherein the first section is inclined downward at a first circumferential inclination angle along the circumferential direction, and wherein the third section is inclined upward at a second circumferential inclination angle greater than the first circumferential inclination angle along the circumferential direction.

7. The cleaner of claim 6, wherein the second section has a smaller inclination angle than the first circumferential inclination angle and the second circumferential inclination angle.

8. The cleaner of claim 2, further comprising a suction pipe through which external air is suctioned into the cyclone, wherein the third section is adjacent to the suction pipe.

9. The cleaner of claim 8, wherein the third section is horizontally offset from a center of the suction pipe, and wherein at least a part of the third section overlaps the suction pipe in a horizontal direction.

10. The cleaner of claim 2, wherein the first section comprises an outer circumferential surface and an inner circumferential surface, and wherein at least a part of the first section is inclined downward from the outer circumferential surface to the inner circumferential surface.

11. The cleaner of claim 10, wherein an inclination angle of a first end of the first section is less than an inclination angle of a second end of the first section opposite the first end.

12. The cleaner of claim 11, wherein a first part of the inner circumferential surface of the first section is spaced a further radial distance from an axis of the dust container than a second part of the inner circumferential surface of the first section, and wherein inner circumferential surfaces of the second section and the third section are spaced at a radial distance equal to the second part of the inner circumferential surface of the first section.

13. The cleaner of claim 11, wherein when a boundary between the first base portion and the third base portion is defined as 0° on a circumference about the axis of the dust container, a boundary between the first base portion and the second base portion is between 170° and 190° on the circumference about the axis of the dust container, and a boundary between the second base portion and the third base portion is between 330° and 350° on the circumference about the axis of the dust container.

14. The cleaner of claim 2, wherein the dust compressor further comprises a connector to which a lifter is connected, and wherein the connector faces the third section with reference to the axis of the dust container.

15. The cleaner of claim 1, wherein the dust compressor further comprises an inner lip that extends downward from at least a part of an inner circumferential surface of the base ring.

16. The cleaner of claim 15, wherein the base ring is divided into a first section, a second section, and a third section along a circumferential direction about an axis of the dust container, and wherein the inner lip is provided at a part of the first section, the second section, and the third section.

17. The cleaner of claim 1, wherein the dust compressor further comprises an outer lip that extends downward from at least a part of an outer circumferential surface of the base ring.

18. The cleaner of claim 17, wherein the base ring is divided into a first section, a second section, and a third section along a circumferential direction about an axis of the dust container, and wherein the outer lip is provided at a part of the first section and a part of the second section.

19. The cleaner of claim 1, wherein the dust container comprises:

a dust collecting body having an opened bottom and a cylindrical shape having a vertical axis; and a body cover rotatably coupled to the bottom of the dust collecting body, wherein the dust collecting body surrounds the at least one cyclone about the vertical axis, and wherein a dust storage area is defined between an outer surface of the at least one cyclone and an inner surface of the dust collecting body.

20. The cleaner of claim 19, wherein the at least one cyclone comprises:

a first cyclone configured to separate dust from suctioned air by a cyclonic airflow;

a second cyclone provided inside the first cyclone; and a flow space defined between an inner circumferential surface of the first cyclone and an outer circumferential surface of the second cyclone, and wherein the flow space communicates with the dust storage.

* * * * *